US011040260B1

(12) United States Patent
Isgar

(10) Patent No.: US 11,040,260 B1
(45) Date of Patent: Jun. 22, 2021

(54) CUSTOMIZED GOLF CLUB GRIP

(71) Applicant: Charles Isgar, Scottsdale, AZ (US)

(72) Inventor: Charles Isgar, Scottsdale, AZ (US)

( * ) Notice: Subject to any disclaimer, the term of this patent is extended or adjusted under 35 U.S.C. 154(b) by 0 days.

(21) Appl. No.: 16/577,291

(22) Filed: Sep. 20, 2019

Related U.S. Application Data

(63) Continuation-in-part of application No. 16/566,091, filed on Sep. 10, 2019, which is a continuation-in-part of application No. 16/381,785, filed on Apr. 11, 2019, now Pat. No. 10,589,156, which is a continuation of application No. 16/014,997, filed on Jun. 21, 2018, now Pat. No. 10,300,359.

(60) Provisional application No. 62/618,906, filed on Jan. 18, 2018.

(51) Int. Cl.

| | |
|---|---|
| ***A63B 53/14*** | (2015.01) |
| ***A63B 60/22*** | (2015.01) |
| ***A63B 60/32*** | (2015.01) |
| ***A63B 53/00*** | (2015.01) |
| *A63B 60/30* | (2015.01) |
| *A63B 60/26* | (2015.01) |
| *A63B 60/42* | (2015.01) |
| *A63B 60/14* | (2015.01) |
| *A63B 60/46* | (2015.01) |
| *A63B 60/12* | (2015.01) |
| *A63B 60/06* | (2015.01) |
| *A63B 60/08* | (2015.01) |

(52) U.S. Cl.
CPC ..... *A63B 60/22* (2015.10); *A63B 53/007* (2013.01); *A63B 53/14* (2013.01); *A63B 60/32* (2015.10); *A63B 60/06* (2015.10); *A63B 60/08* (2015.10); *A63B 60/12* (2015.10); *A63B 60/14* (2015.10); *A63B 60/26* (2015.10); *A63B 60/30* (2015.10); *A63B 60/42* (2015.10); *A63B 60/46* (2015.10); *A63B 2060/464* (2015.10); *A63B 2220/56* (2013.01); *A63B 2220/833* (2013.01)

(58) Field of Classification Search
CPC ..... A63B 53/14; A63B 60/12; A63B 60/06; A63B 60/14; A63B 60/08; A63B 2060/464; A63B 60/42; A63B 2220/56; A63B 2220/833; A63B 60/46
USPC ..... 473/300, 301, 302, 303, 202, 568, 549, 473/299
See application file for complete search history.

(56) References Cited

U.S. PATENT DOCUMENTS

| | | | | |
|---|---|---|---|---|
| 3,804,413 | A | 4/1974 | Hrivnak | |
| 3,834,714 | A | 9/1974 | Smolinski | |
| 5,586,946 | A | 12/1996 | Haber | |
| 7,510,483 | B2 * | 3/2009 | Tremulis | A63B 53/14 473/300 |
| 8,944,929 | B1 * | 2/2015 | Smith | A63B 71/0622 473/202 |
| 10,300,359 | B1 | 5/2019 | Isgar | |
| 2001/0041626 | A1 | 11/2001 | Madelle | |
| 2003/0036436 | A1 * | 2/2003 | Casanova, Jr. | A63B 69/36 473/202 |
| 2005/0079924 | A1 | 4/2005 | Heinecke | |

(Continued)

*Primary Examiner* — Benjamin Layno
(74) *Attorney, Agent, or Firm* — Schmeiser, Olsen & Watts LLP

(57) ABSTRACT

Provided is a customized golf club grip and methods of forming the same. The customized golf grips may include customization based on pronation and supination, a computer aided system for producing customized golf grips, a mold for producing a customized grip, a smart grip and use thereof for a customized grip, and the like.

8 Claims, 42 Drawing Sheets

(56) References Cited

U.S. PATENT DOCUMENTS

| | | | | |
|---|---|---|---|---|
| 2005/0197201 | A1 | 9/2005 | Schoeninger | |
| 2006/0094525 | A1 | 5/2006 | Hung | |
| 2007/0079914 | A1 | 4/2007 | Larson | |
| 2008/0200288 | A1* | 8/2008 | Phelan | A63B 59/50 473/568 |
| 2010/0151975 | A1* | 6/2010 | Hisle | A63B 60/12 473/568 |
| 2011/0224012 | A1* | 9/2011 | Hashimoto | A63B 60/42 473/223 |
| 2014/0066221 | A1 | 3/2014 | Chen | |
| 2016/0287956 | A1 | 10/2016 | Wang | |
| 2017/0151475 | A1 | 6/2017 | Krouse | |
| 2018/0117432 | A1* | 5/2018 | Aliberti | A63B 60/46 |
| 2020/0023252 | A1 | 1/2020 | Zmuda | |

* cited by examiner

CUSTOMIZED GOLF CLUB GRIP

CROSS REFERENCE TO RELATED APPLICATION[S]

This application is a continuation-in-part of U.S. patent application entitled "CUSTOM GRIP," Ser. No. 16/566,091, filed Sep. 10, 2019, which is a continuation-in-part of U.S. patent application entitled "ADJUSTABLE GRIP," Ser. No. 16/381,785, filed Apr. 11, 2019, now U.S. Pat. No. 10,589,156, which is a continuation of U.S. patent application entitled "ADJUSTABLE PUTTER GRIP," Ser. No. 16/014,997, filed Jun. 21, 2018, now U.S. Pat. No. 10,300,359, which claims priority to U.S. Provisional Patent Application entitled "PUTTER GRIP," Ser. No. 62/618,906, filed Jan. 18, 2018, the disclosures of which are hereby incorporated entirely herein by reference.

BACKGROUND OF THE INVENTION

Technical Field

This invention relates generally to a golf club grip and more particularly to a customized golf club grip and methods of forming the same.

State of the Art

There are numerous types of grips that can be installed on a golf club. While conventional grips have different sizes and shapes, they are all maintained in a fixed position on the shaft of a golf club, requiring a fixed parallel grip. These conventional grips do not allow for any modification to the grip to adjust for anatomical variances by having custom grip positions that are more natural to enable the golfer to have a comfortable and better swing of the golf club. With these conventional golf club grips, the golfer must adjust his or her holding of the traditional grip without being able to accommodate their unique hand angle orientation.

Accordingly, there is a need for an improved customized golf club grip that can account for anatomical variances in golfers.

DISCLOSURE OF THE INVENTION

The golf industry has approved adjustability in certain clubs and this invention recognizes this trend and further assists golfers in customizing the golf club to their preferences.

The present invention relates to a customized golf club grip for a multitude of custom grip positions for every golfer. This invention allows the golfer to adjust the orientation of the grip to allow either hand to pronate or supinate as desired. Splitting of the grip allows changing the orientation of the hands. The invention further provides for an anatomically, ergonomically customized golf club grip. Variability of grip accommodates a wide spectrum of anatomical variations in human arms, wrists and hands.

An embodiment includes a customized smart grip comprising: a grip member with embedded pressure sensors; and at least one indicator coupled to the grip member, wherein: the indicator alerts a golfer gripping the grip member that the pressure applied by the golfer gripping the grip member is within a predetermined pressure threshold range.

Another embodiment includes a method of forming a customized grip, the method comprising: receiving a grip mold squeezed by a golfer forming a unique anatomical mold of the golfer's hands; and forming the customized grip as a unitary body, wherein the customized grip is formed from the unique anatomical mold.

Another embodiment includes a method of forming a customized grip comprising: collecting grip pressure data from a smart grip comprising imbedded pressure sensors, wherein the grip pressure data includes a magnitude and location of pressure points of a golfer's hands gripping the smart grip; and manufacturing a custom grip with at least a first substrate and a second substrate wherein the first substrate is softer than the second substrate, wherein the customized grip is formed with the first substrate located in the location of pressure points that have the magnitude of pressure above a predetermined pressure magnitude and the second substrate is located in the portion of the customized grip in locations where the magnitude of pressure is below the predetermined pressure magnitude.

The foregoing and other features and advantages of the present invention will be apparent from the following more detailed description of the particular embodiments of the invention, as illustrated in the accompanying drawings.

BRIEF DESCRIPTION OF THE DRAWINGS

A more complete understanding of the present invention may be derived by referring to the detailed description and claims, when considered in connection with the Figures, wherein like reference numbers refer to similar items throughout the Figures, and:

DETAILED DESCRIPTION OF EMBODIMENTS OF THE INVENTION

As discussed above, embodiments of the present invention relate to a customized golf club grip that may be formed by use of an adjustable golf club grip for adjusting grip position where each hand may have an independently variable orientation to each other. The invention further provides for forming the customized grip corresponding to the selected orientation of the adjustable golf club grip and then forming the customized golf club grip that is an anatomically, ergonomically custom golf club grip. Variability of the customized grip accommodates individual uniqueness of human hands, wrists and connecting anatomy.

Figure 1:
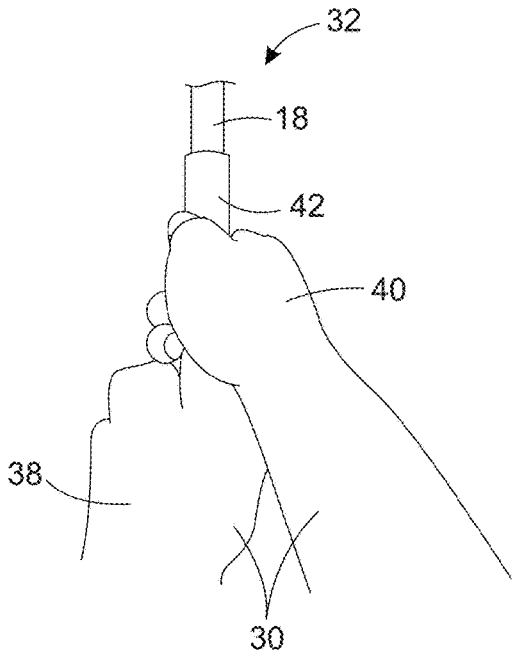
FIG. 1 is a perspective view of a neutral grip position of a golfer's hands on a golf club grip according to an embodiment.
Figure 2:
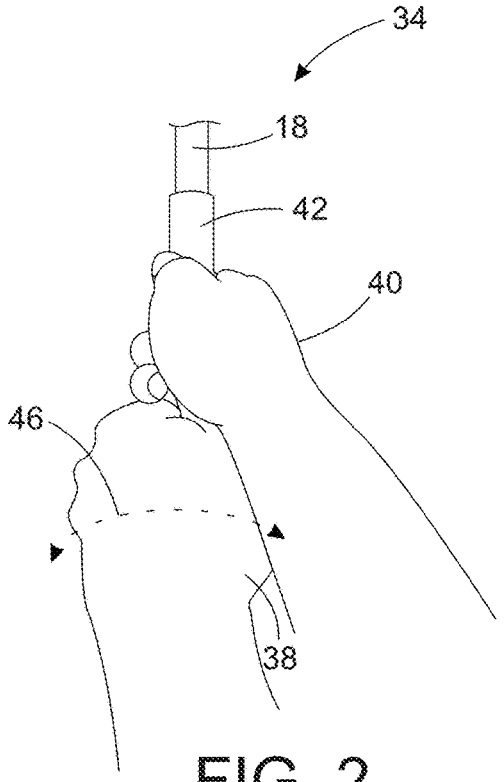
FIG. 2 is a perspective view of a grip position of a golfer's hands on a golf club grip with the left hand pronated according to an embodiment.
Figure 3:
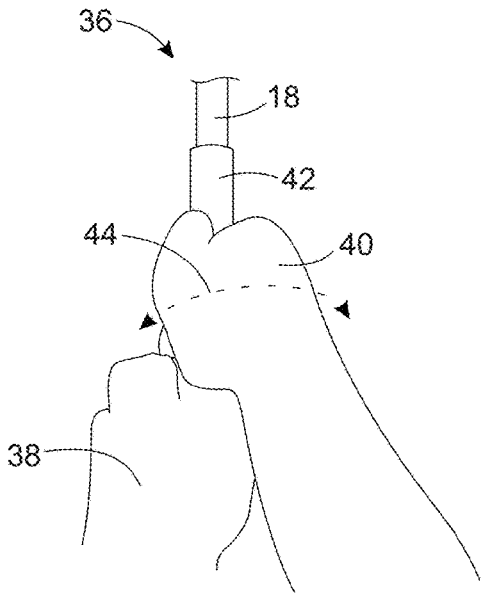
FIG. 3 is a perspective view of a grip position of a golfer's hands on a golf club grip with the right hand pronated according to an embodiment.
Figure 4:
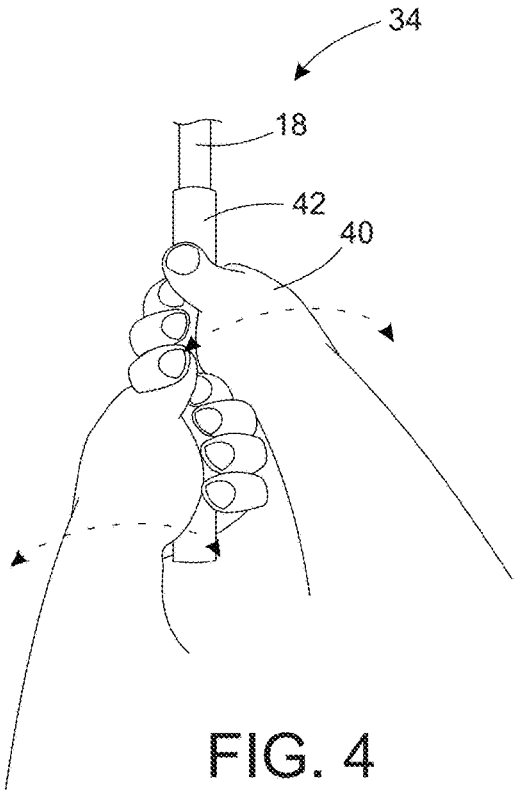
FIG. 4 is a perspective view of a grip position of a golfer's hands on a golf club grip with the right and left hands supinated according to an embodiment.

In order to adjust grip position on a conventional golf club grip, a golfer needs to rotate his or her hand to a different position on the golf club grip, resulting in the palm or other parts of the hand to be removed or lack comfortable contact with the golf club grip. For example, FIG. 1 is a top perspective view of a typical neutral grip position of a golfer's hands on a golf club grip. FIG. 2 illustrates a grip position of a golfer's hands on a golf club grip, wherein the left hand is pronated in a clockwise direction with respect to the right hand held in a neutral position. It will be understood that, as shown in FIG. 2, the left hand may be pronated or supinated with the right hand held neutral. FIG. 3 illustrates a grip position of a golfer's hands on a golf club grip, wherein the right hand is pronated in a counterclockwise direction with respect to the left hand held in a neutral position. It will be understood that, as shown in FIG. 3, the right hand may be pronated or supinated with left hand held neutral. FIG. 4 depicts another grip wherein the grip is customized for the golfer by the right and left hands having the ability to be independently pronated and supinated in order to account for anatomical variances of different golfers. The above examples are not intended to be limiting as to the possible grip positions and orientations of a golfer's hands on a golf club grip.

Embodiments of the adjustable golf club grip allow a user to adjust the golf club grip to positions and orientations to allow the golfer to rotate the grip position of a hand independent from the grip position of the other hand to allow for a rotated or twisted grip position while still maintaining contact with the golf club grip with the typical parts of the golfer's hands, such as the palm. In other words, the golfer may independently pronate or supinate each hand and adjust the golf club grip to match the hand position.

Figure 5:
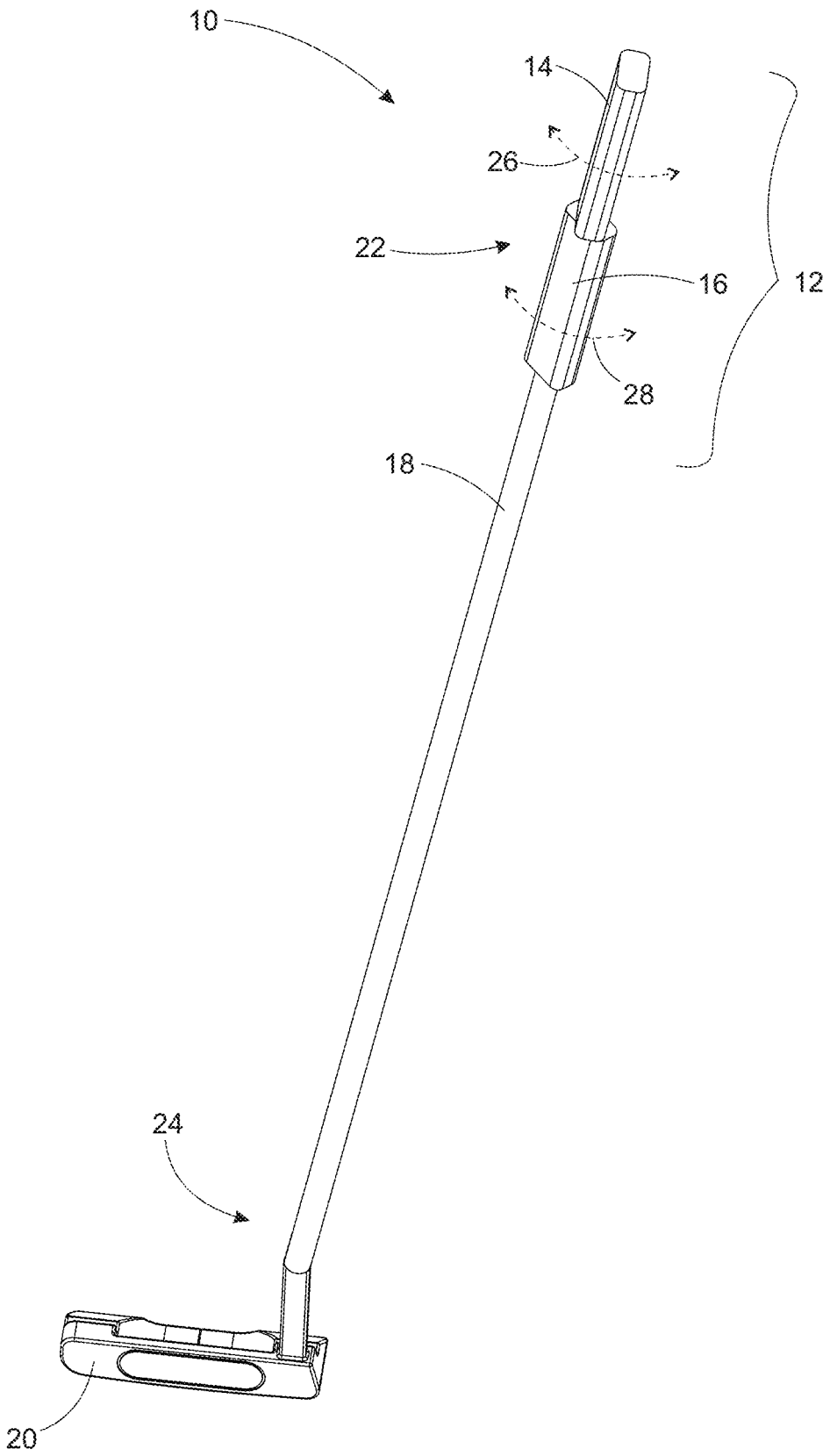
FIG. 5 is a perspective view of a golf club with an adjustable golf club grip according to an embodiment.

Embodiments, as depicted in FIG. 5, include a golf club 10 with an adjustable golf club grip 12 having a first grip member 14 and a second grip member 16. Embodiments of the golf club grip 12 allow for a variety of advanced hand positions for the golf swing. This is generally accomplished through a variable position grip assembly 12 surrounding the golf club shaft 18. The grip 12 is split into a first grip member 14 and a second grip member 16. In embodiments, one grip member 14 or 16 may rotate while the other remains stationary, while in other embodiments, each grip member 14 and 16 may be rotated relative to one another around the shaft 18 to orient in particular locations that enable the golfer to grasp the golf club in an optimal and consistent manner. The adjustable golf club grip 12 may include a securing device to secure or lock the first and second grip members 14 and 16 into the desired or selected orientation.

Figure 6C:
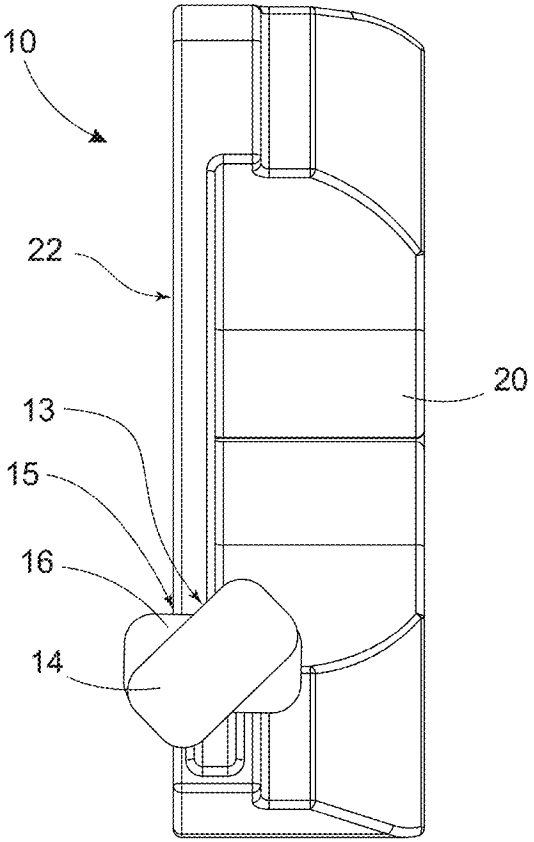
FIG. 6C is a top view of a putter with an adjustable putter grip in a third position according to an embodiment.
Figure 6B:
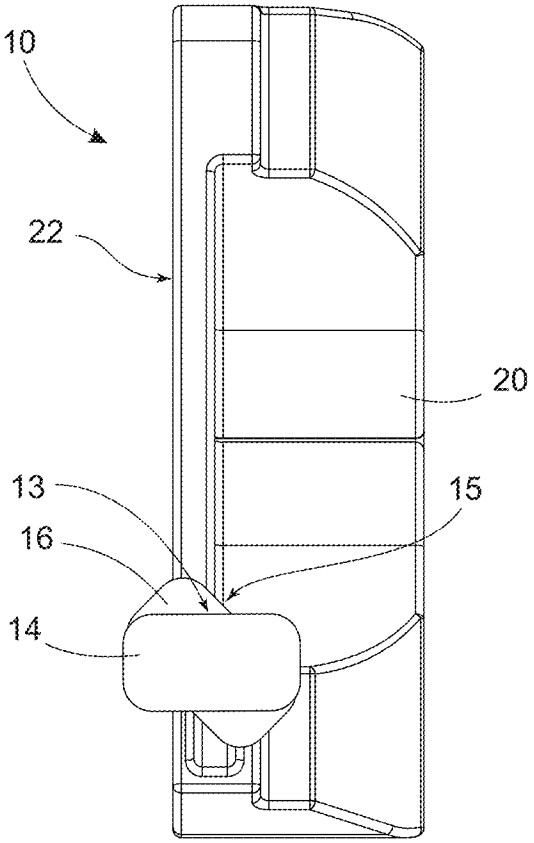
FIG. 6B is a top view of a putter with an adjustable putter grip in a second position according to an embodiment.
Figure 6A:
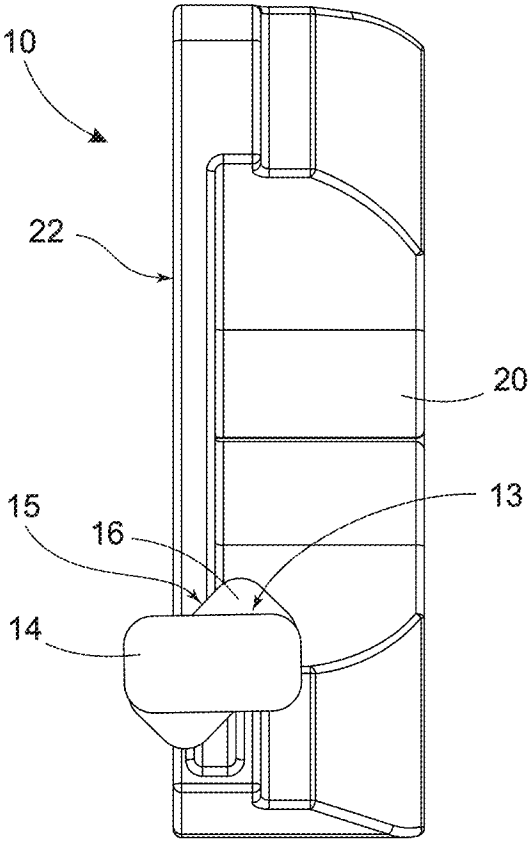
FIG. 6A is a top view of a putter with an adjustable putter grip in a first position according to an embodiment.
Figure 6F:
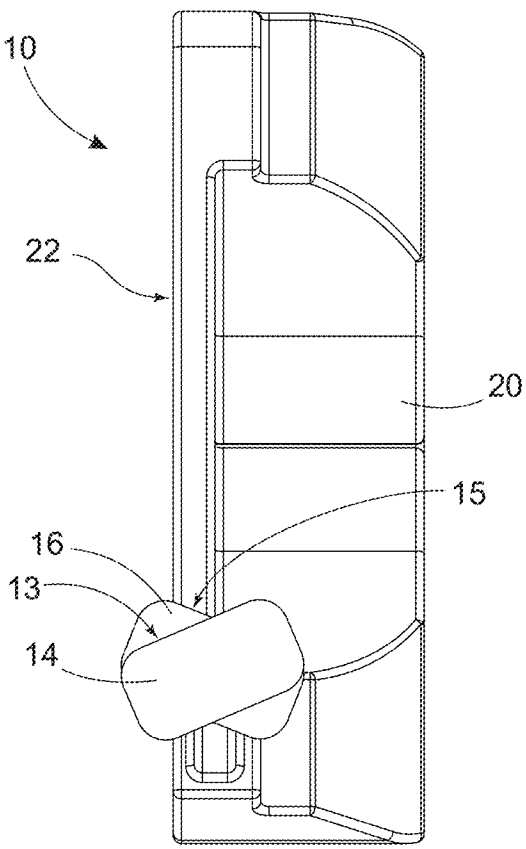
FIG. 6F is a top view of a putter with an adjustable putter grip in a sixth position according to an embodiment.
Figure 6E:
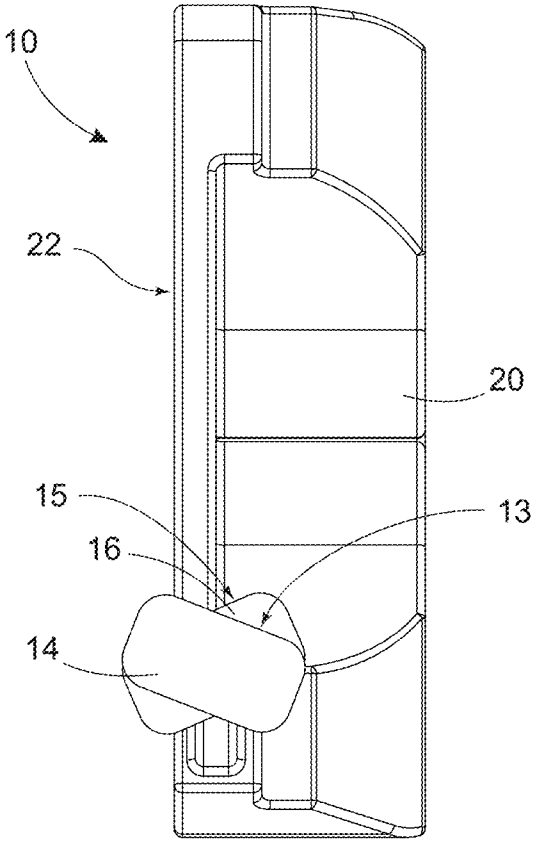
FIG. 6E is a top view of a putter with an adjustable putter grip in a fifth position according to an embodiment.
Figure 6D:
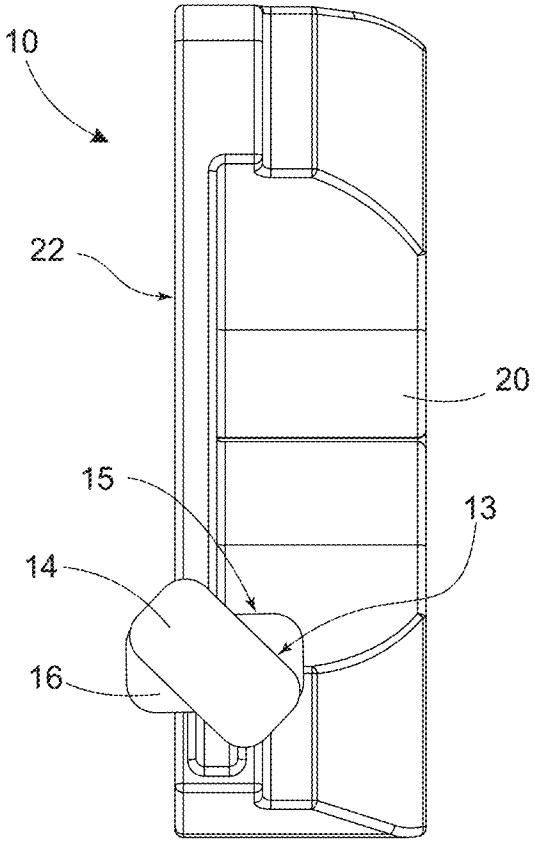
FIG. 6D is a top view of a putter with an adjustable putter grip in a fourth position according to an embodiment.

Referring further to the drawings, FIGS. 6A-6F depict various ways that the custom grip may be coupled to a golf club, such as a putter. It should be appreciated that the angles of rotation of the first and second grip members 14 and 16 are exaggerated in order to depict clearly the functionality of the present invention. In FIGS. 6A-6B the first grip member 14 has the first contact surface 13 substantially perpendicular to the face 22 of the putter 20 with the second contact surface 15 at an angle to both the first contact surface 13 and the face 22 of the putter 20. In FIG. 6C-6D the second grip member 14 has the second contact surface 15 substantially perpendicular to the face 22 of the putter 20 with the first contact surface 13 at an angle to both the second contact surface 15 and the face 22 of the putter 20. In FIG. 6E-6F the first grip member 14 has the first contact surface 13 at an angle with respect to the second contact surface 15, with first contact surface 13 and the second contact surface 15 at different angles with respect to the face 22 of the putter 20. These orientations of first grip member 14 to second grip member 16, and the orientation of the grip 10 coupled to the shaft of the putter, are provided for exemplary purposes only and are not viewed as limitations to the invention.

Figure 7:
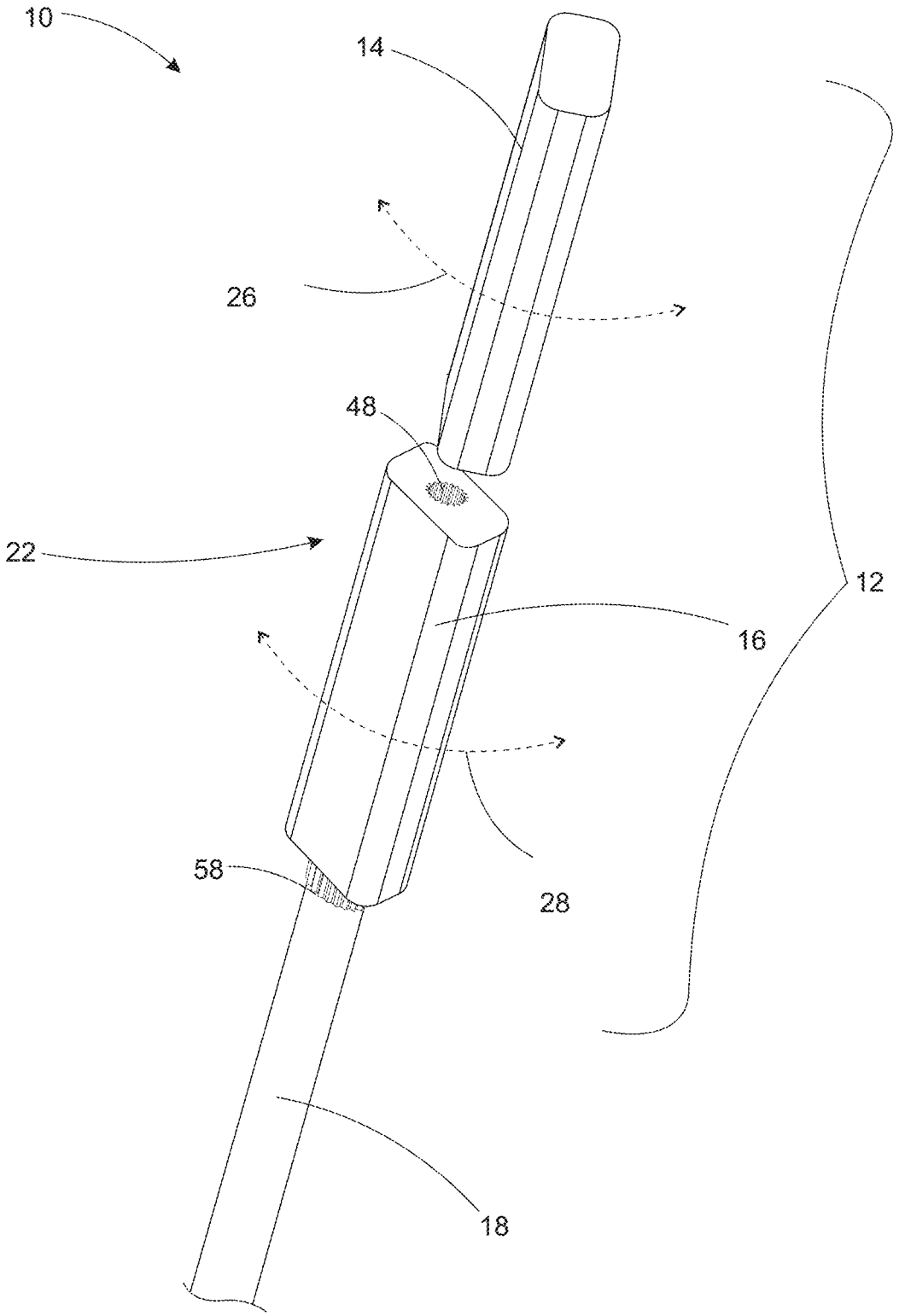
FIG. 7 is an exploded view of a golf club shaft with the golf club grip members adjusting according to an embodiment.
Figure 8:
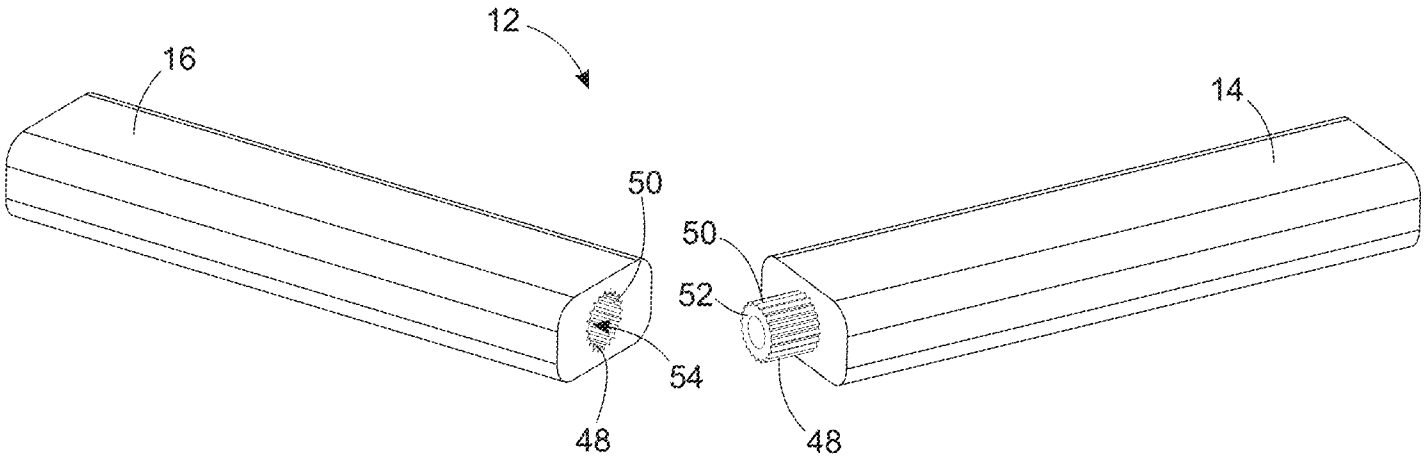
FIG. 8 is an exploded view of an adjustable golf club grip according to an embodiment.
Figure 9:
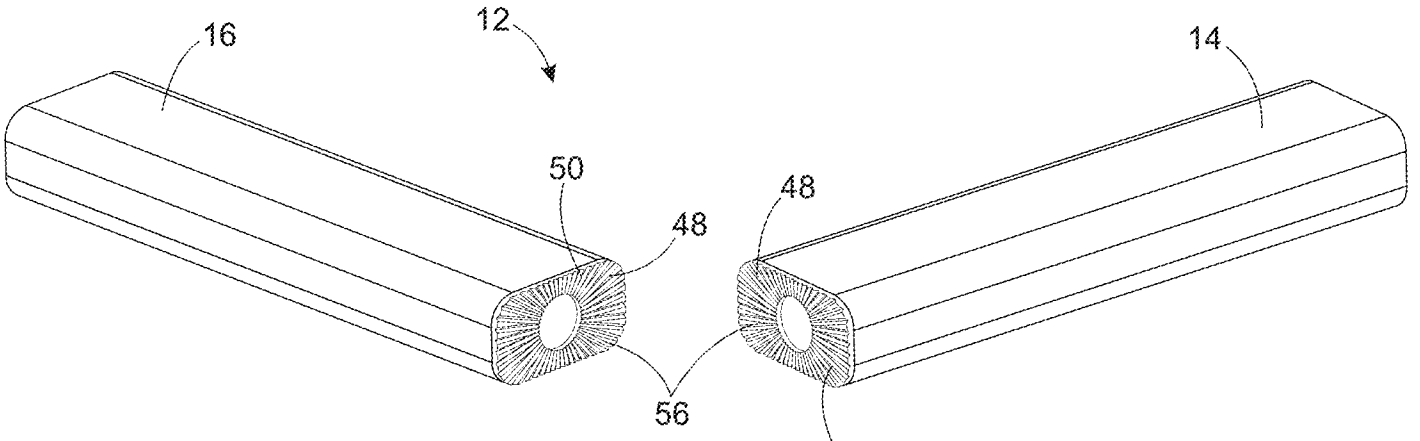
FIG. 9 is an exploded view of an adjustable golf club grip according to another embodiment.

In some embodiments, depicted in FIGS. 7-9, the first and second grip members 14 and 16 are connected to each other and to the shaft 18 by teeth of respective spline sets that can easily be moved between detached and locked engagements. In these embodiments, the shaft and the grip members 14 and 16 may be separated from each other and then connected using the teeth to respective spline sets to orient the first and second grip members 14 and 16 in the user-defined orientation. The ease of detaching and altering the grip allows any user to customize his or her grip on the fly or at any time to accommodate the wrist angle the golfer finds most comfortable or consistent so that the golf club head 20 will strike the golf ball at a generally consistent angle during successive strokes.

In some embodiments, as shown in FIG. 8, the first grip member 14 comprises a male splined protrusion 52 and the second grip member 16 comprises a female splined recess 54, such that the male splined protrusion 52 and the female splined recess 54 may engage each other to prevent the first grip member 14 from rotating with respect to the second grip member 16. In some embodiments, the second grip member 16 comprises a male splined protrusion that may engage a female splined recess of the first grip member 14. The splines shown in FIG. 8 is an embodiment of the securing device.

In some embodiments, as shown in FIG. 9, the first and second grip members 14 and 16 each comprise a splined end surface 56, such that the splined end surfaces 56 of the first and second grip members 14 and 16 may engage each other to prevent the first grip member 14 from rotating with respect to the second grip member 16.

In some embodiments shown in FIGS. 7-9, the golf club shaft 18 comprises a spline set 50 having teeth that extend radially outward from the surface thereof. The first grip member 14 comprises a female splined recess 54 and the second grip member 16 comprises a splined aperture extending lengthwise through the second grip member, the female splined recess 54 and the splined aperture each having teeth 48 that extend radially inward from the inner surfaces thereof and engage the spline set 50 of the golf club shaft when the first grip member 14 and second grip member 16 are coupled, either removably or permanently, to the golf club shaft 18, such that the first grip member 14 and the second grip member 16 are prevented from rotating relative to the golf club shaft 18. The splines shown in FIGS. 7-9 are embodiments of the securing device.

Although the teeth 48 of the spline sets 50 shown in FIGS. 7-9 are of substantially triangular shape, this is not intended to be limiting. The teeth 48 of the spline sets 50 may be of any suitable shape, such as substantially rectangular, fluted, or of any other shape that is suitable for use as teeth of a spline set. Further, the teeth 48 of a spline set 50 may be any protrusions of any shape that are suitable to engage any recesses of a corresponding spline set 50 of corresponding shape known to a person of ordinary skill in the art.

As shown in FIGS. 5-6F, the first grip member 14 is coupled adjacent a first end 22 of a golf club shaft 18, wherein the golf club head 20 is coupled to the second end 24 of the golf club shaft 18. The second grip member 14 is coupled to the golf club shaft 18 between the first grip member 14 and the second end 24 of the golf club shaft 18. The first grip member 14 and/or the second grip member 16 may rotate about the shaft 18 in either direction as depicted by arrows 26 and 28 respectively. By so doing, the user can adjust the grip position of each hand independently.

Embodiments may include a locking collar (not shown) that surrounds the shaft 18 and slides axially along the shaft 18 into engagement with the grip assembly 12 to prevent the rotation of the first and second grip members 14 and 16 around the shaft 18 while putting. The locking collar is an embodiment of the securing device and may be locked or secured in a locked position by any means suitable to secure a grip member to a golf club shaft, such as by a set pin, a set screw, a lock pin, a clamping lever, a threaded nut, an axial clamp, and the like. Further, this becomes a partial equipment answer to having the hands of a user feel more comfortable. Further still, embodiments allow the golfer to pronate or supinate his or her hands in matching symmetry and further allows the golfer to pronate or supinate his or her hands independently to account for anatomical variances between each golfer.

In some embodiments, the first and second grip members 14 and 16 each comprise a locking collar that may be coupled to or which forms an integral part of the grip member. The locking collar may be locked or secured in a locked position by any means suitable to secure the grip member to a golf club shaft, such as by a set pin, a set screw, a lock pin, a clamping lever, a threaded nut, an axial clamp, and the like, such that a user may easily adjust the orientation of each grip member independently on the fly, or at any time, by unlocking the locking collar, turning the grip member to the desired orientation, and then locking the locking collar.

It will be understood that, while splines and a locking collar are shown as embodiments of a securing device, other securing devices may be used. Accordingly, any type of securing device may be used, so long as the securing device secures the first and second grip members 14 and 16 in the desired orientation.

In embodiments, the grip members can move independently around the shaft. Grip members may also not move at all, wherein the manufacturer may apply the grip members to the shaft at the desired orientations. Other embodiments, as discussed above, may be adjusted either by a user or by a factory before sale.

Figure 10:
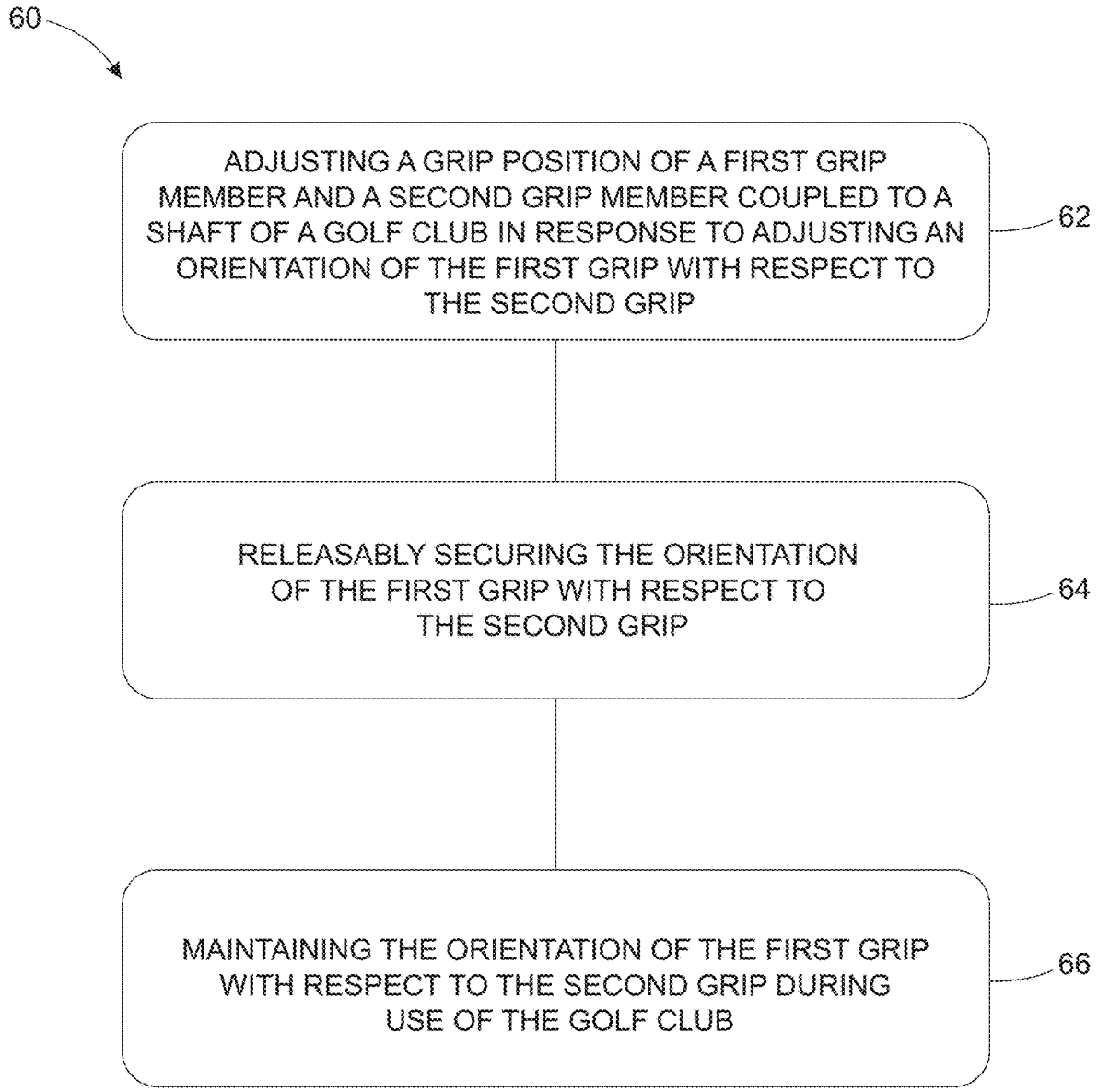
FIG. 10 is a flow diagram representing steps of a method of use of an adjustable golf club grip.
Figure 11A:
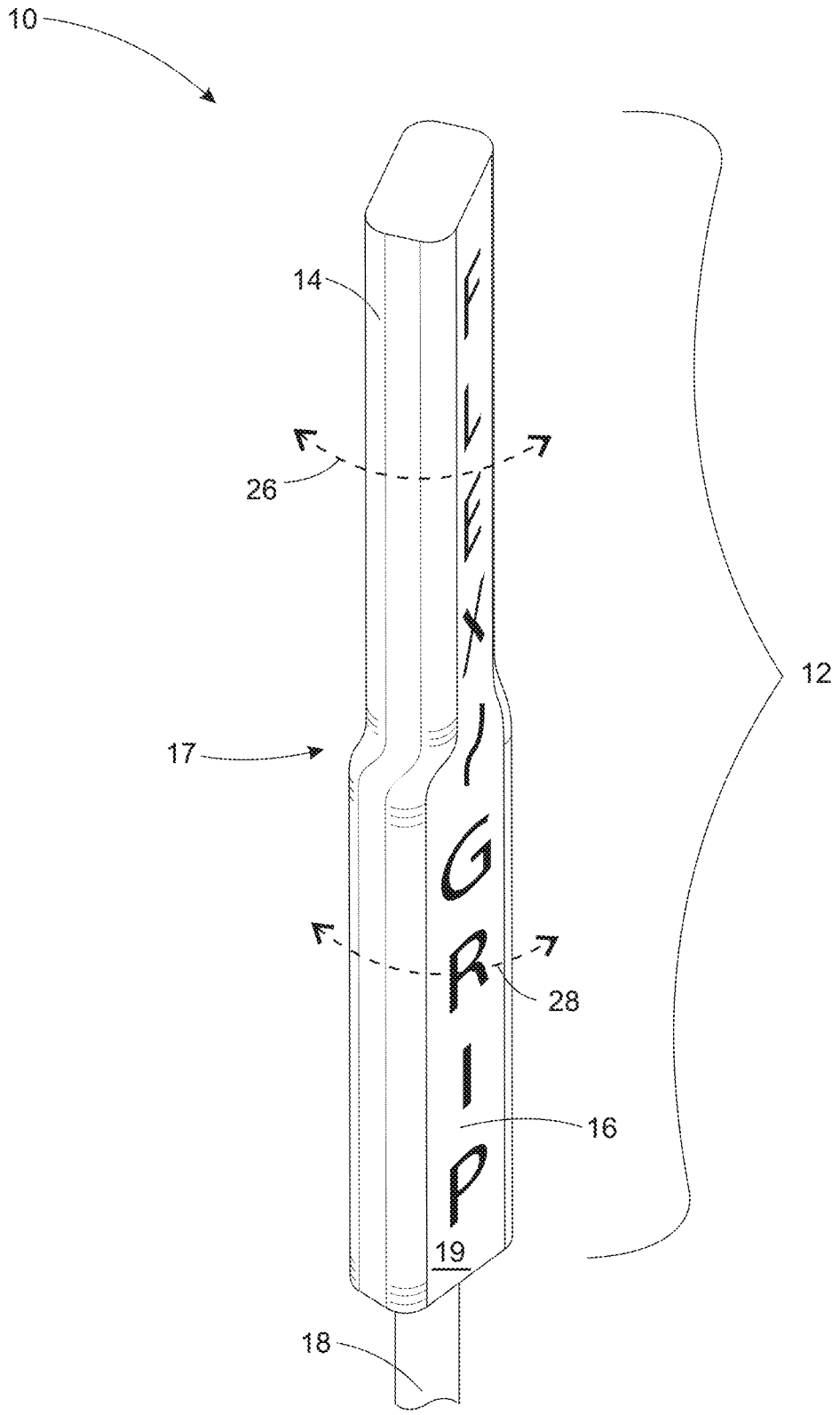
FIG. 11A is a perspective view of an adjustable golf club grip according to an embodiment.
Figure 11B:
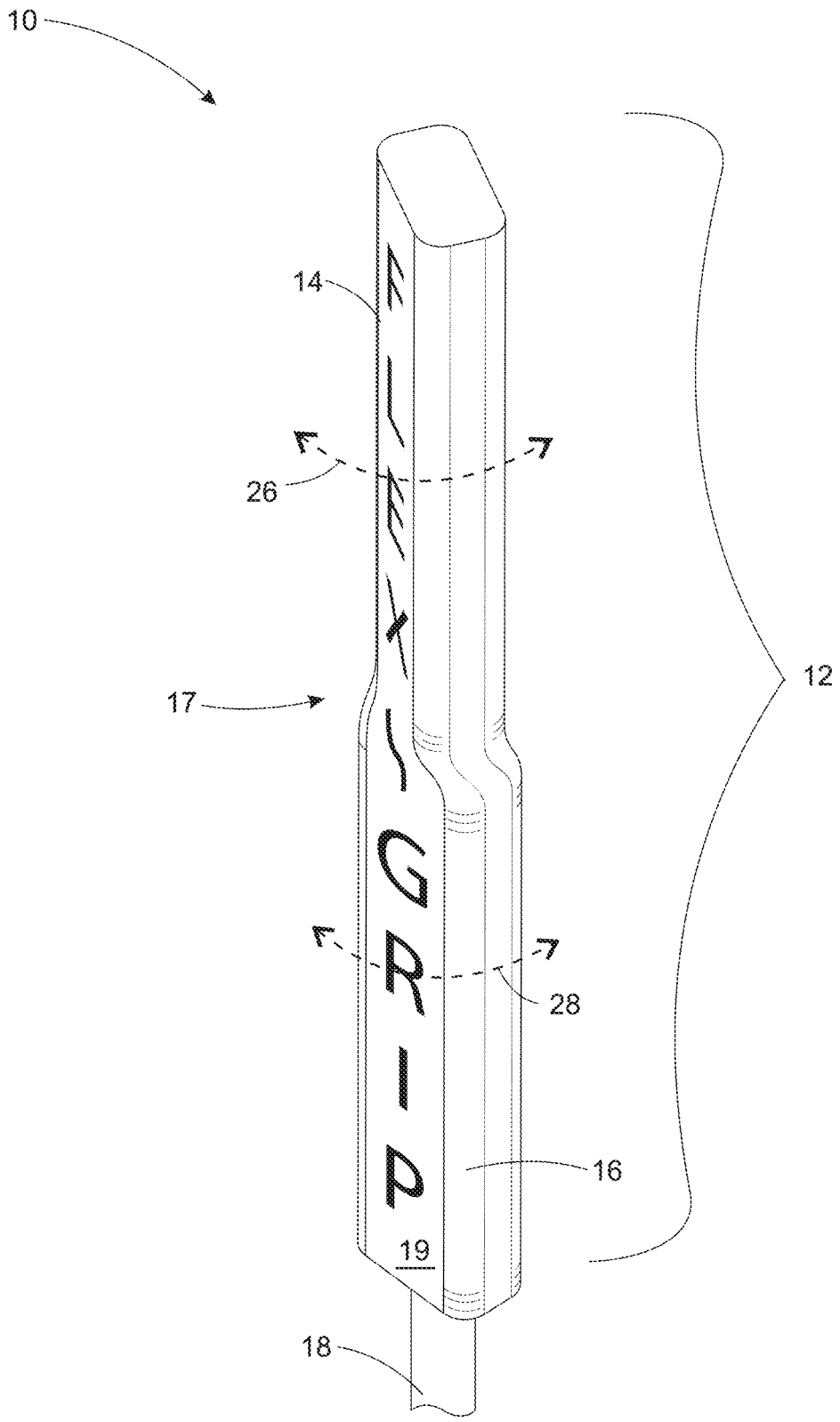
FIG. 11B is a perspective view of an adjustable golf club grip according to an embodiment.
Figure 11C:
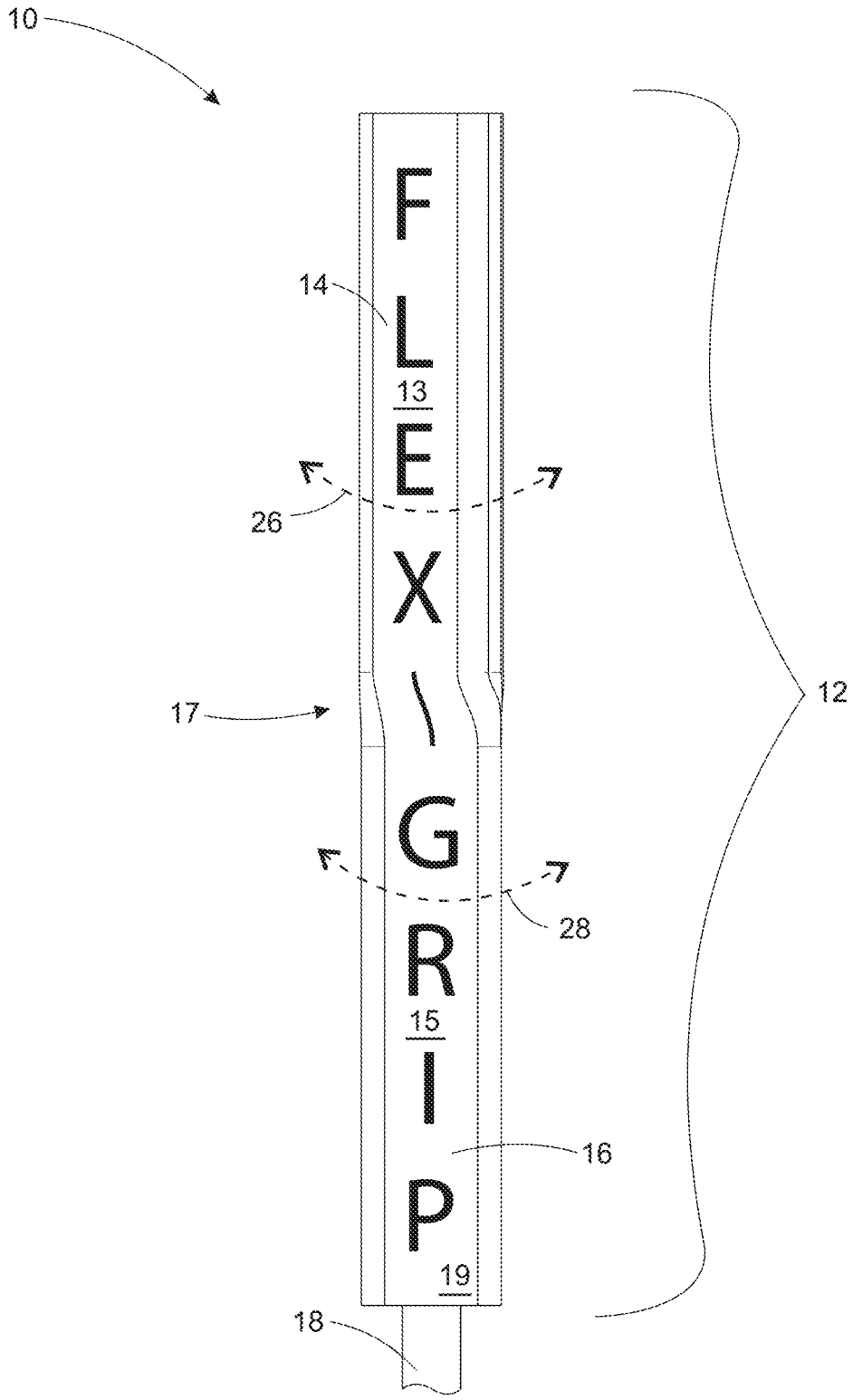
FIG. 11C is another perspective view of an adjustable golf club grip according to an embodiment.
Figure 11D:
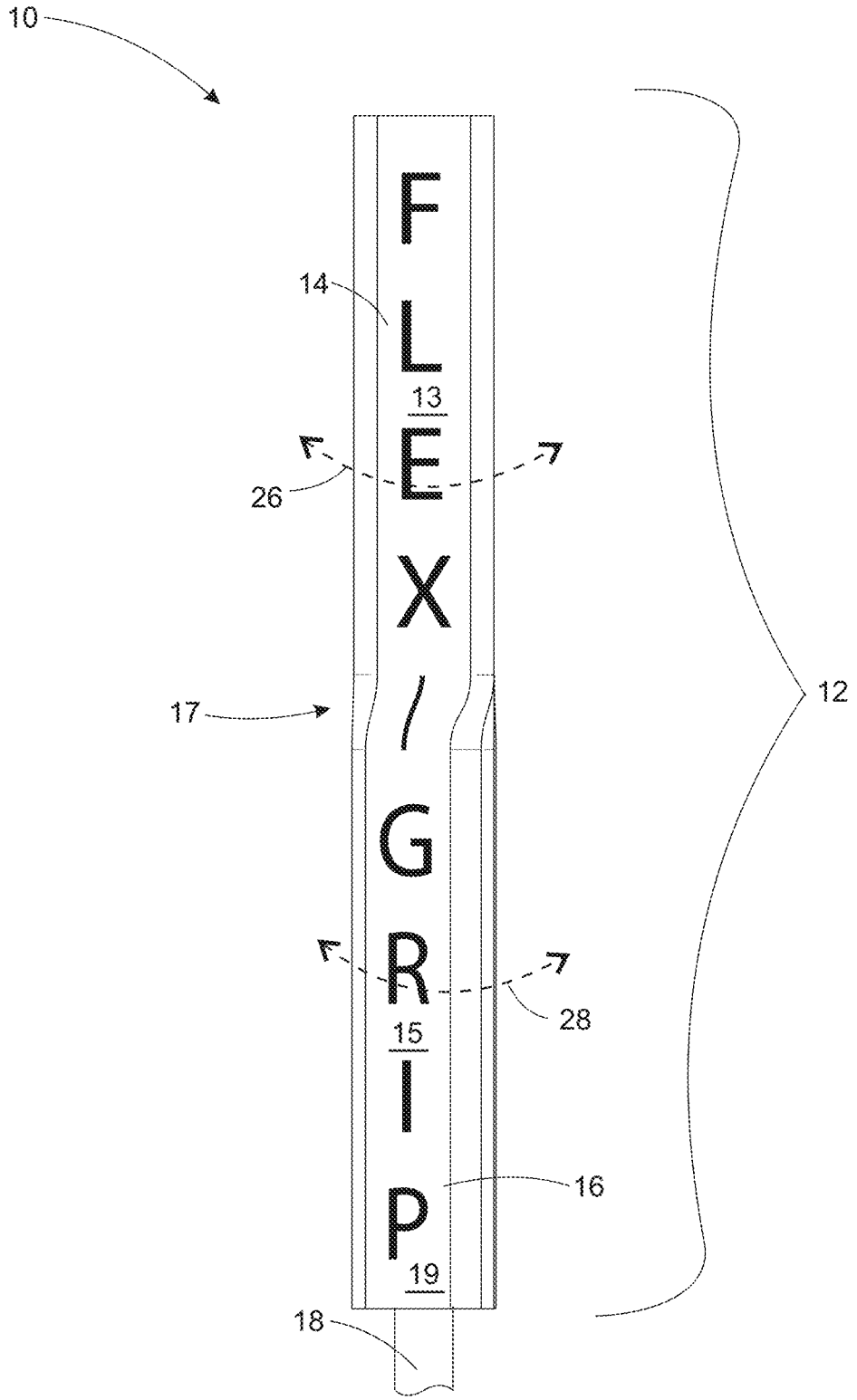
FIG. 11D is a further perspective view of an adjustable golf club grip according to an embodiment.

Referring to FIG. 10, a block diagram of a method 60 of use of an adjustable golf club grip is depicted. The method 60 comprises adjusting a grip position of a first grip member and a second grip member coupled to a shaft of a golf club in response to adjusting an orientation of the first grip with respect to the second grip (Step 62); releasably securing the orientation of the first grip with respect to the second grip (Step 64); and maintaining the orientation of the first grip with respect to the second grip during use of the golf club (Step 66).

Step 62 of adjusting the orientation of the first grip member with respect to the second grip member may further include rotation of first grip member and the second grip member about the golf club shaft. Alternatively, Step 62 of adjusting the orientation of the first grip member with respect to the second grip member may include rotation of the first grip member about the golf club shaft while the second grip member is fixed to the golf club shaft. Alternatively, Step 62 of adjusting the orientation of the first grip member with respect to the second grip member may include rotation of the second grip member about the golf club shaft while the first grip member is fixed to the golf club shaft.

The securing of the orientation of the first grip member with respect to the second grip member in Step 64 may include any useable securing means, such as that described above with regard to splines or locking collars. Other means and devices are contemplated without departing from the scope of the present invention.

According to embodiments, as shown in FIGS. 11A-11D, a method of forming a custom grip or custom fitting of a golfer is provided. The method may include independently pronating or supinating portions of a golf club grip in a desired position for holding by the golfer's hands; forming a customized single grip corresponding to the desired position of the golfer's hands; and maintaining a fixed customized grip on a shaft of a golf club. In these embodiments, either hand may be held in a neutral position while the other hand is pronated or supinated, or, in another embodiment, both hands may be pronated and supinated independently and simultaneously. In at least this way, embodiments of the invention may be used for custom adjustments or fitting.

Independently pronating and supinating portions of the golf club grip may include the golfer rotating a first portion 14 and a second portion 16 of the golf club grip 12 in any direction displayed by arrows 26 and 28 respectively, with a twist point 17 located between the first and second portions 14 and 16 (see FIGS. 11A-11B); the golfer rotating a first portion 14 in any direction displayed by arrow 26 while a second portion 16 is held in a neutral position, with a twist point 17 located between the first and second portions 14 and 16 (see FIG. 11C); or the golfer rotating a second portion 16 in any direction displayed by arrow 28 while a first portion 14 is held in a neutral position, with a twist point 17 located between the first and second portions 14 and 16 (see FIG. 11D), such that the first and second portions of the grip 12 are positioned in a golfer-determined position at customized angles of rotation. The golf club grip 12 may include a unitary grip cover 19, with malleable material interior to the unitary grip cover 19, to form the first and second grip members 14 and 16. Once the golfer determines the angles of the first and second golf club grip members 14 and 16, they may be set or otherwise secured in the golfer-defined position as a way of forming the customized grip. In some embodiments, the customized grip includes fixing the first and second grip members 14 and 16 in a configuration wherein they cannot be moved again.

The customized grip may be fixed in various ways. In one embodiment, the first and second grip members 14 and 16 may be fixed by use of a mechanical device, as described above. In another embodiment, the first and second grip members may be coupled together with a malleable material that may transition into a non-malleable state, thereby fixing the first and second grip members 14 and 16 in a user-defined position. In another embodiment, the position of the first and the second grip members 14 and 16 may be input into a CAD software, and a customized grip may be manufactured, such as, without limitation, by 3D printing the grip.

Figure 12:
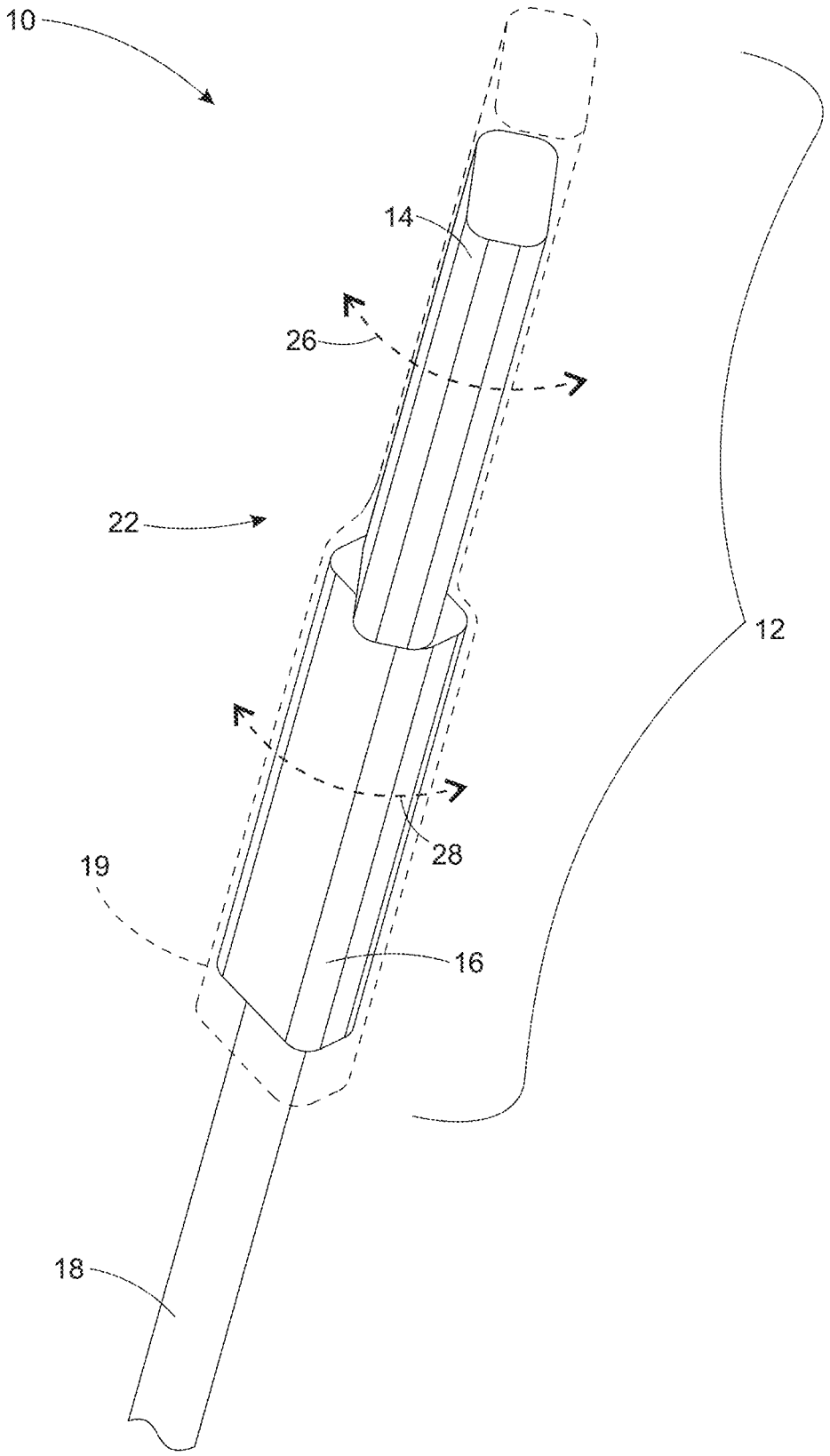
FIG. 12 is a perspective view of an adjustable golf club grip with the outer grip member see-through to see optional inner components according to an embodiment.
Figure 13:
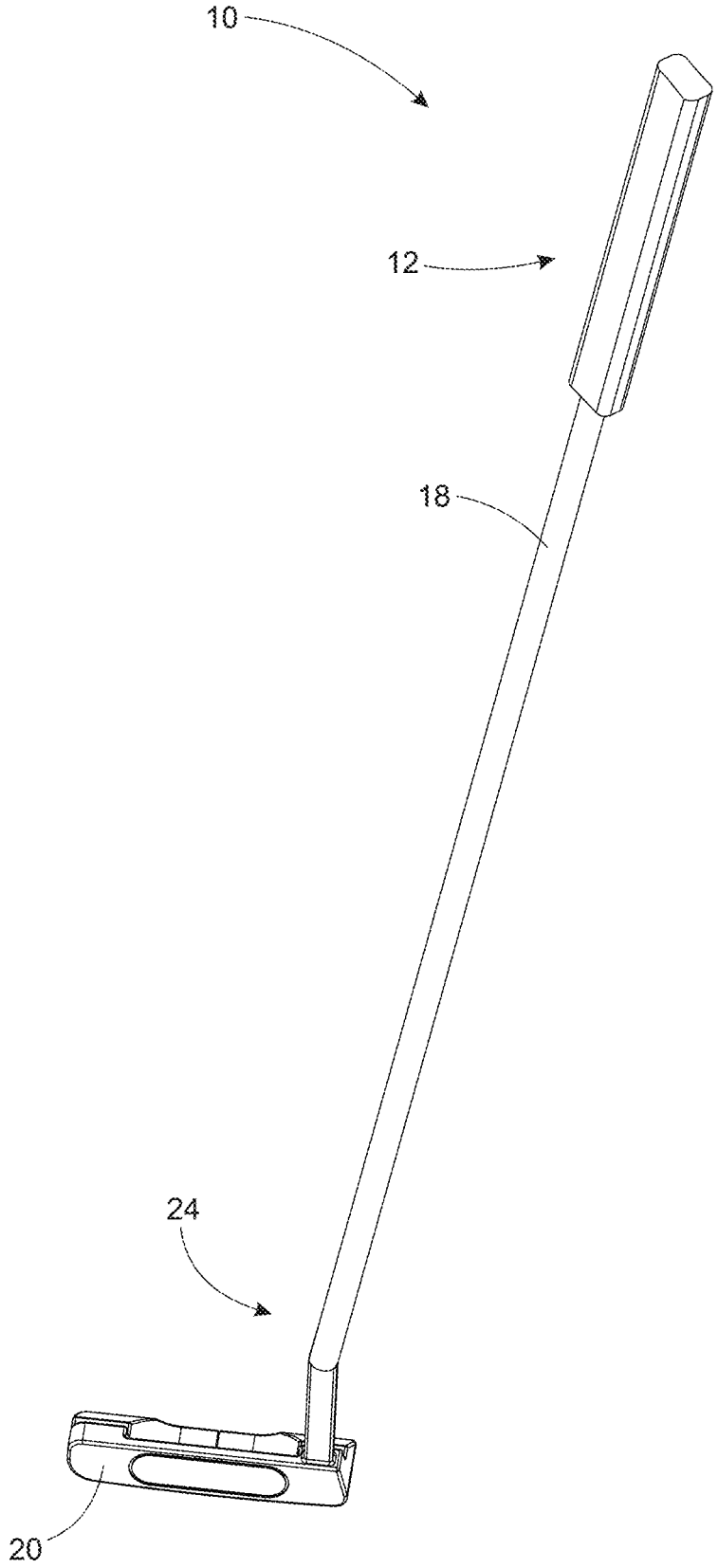
FIG. 13 is a perspective view of a golf club with an adjustable golf club grip according to an embodiment.
Figure 14B:
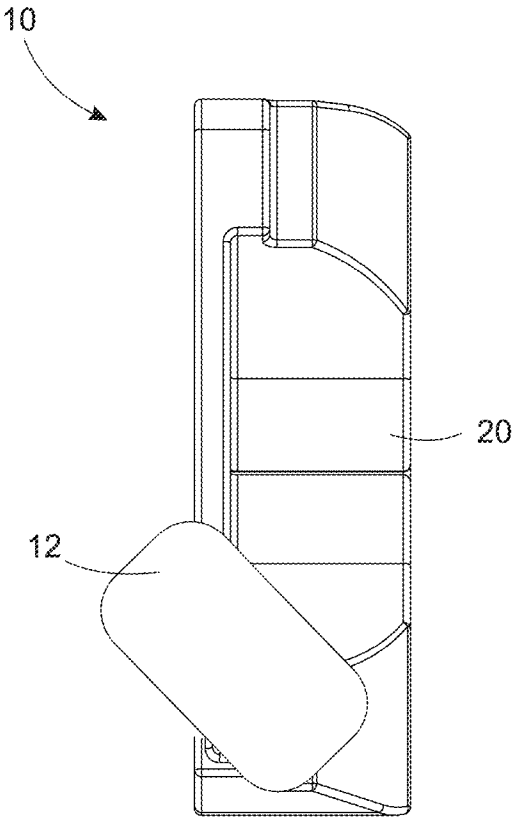
FIG. 14B is another top view of a golf club with an adjustable golf club grip according to an embodiment.
Figure 14A:
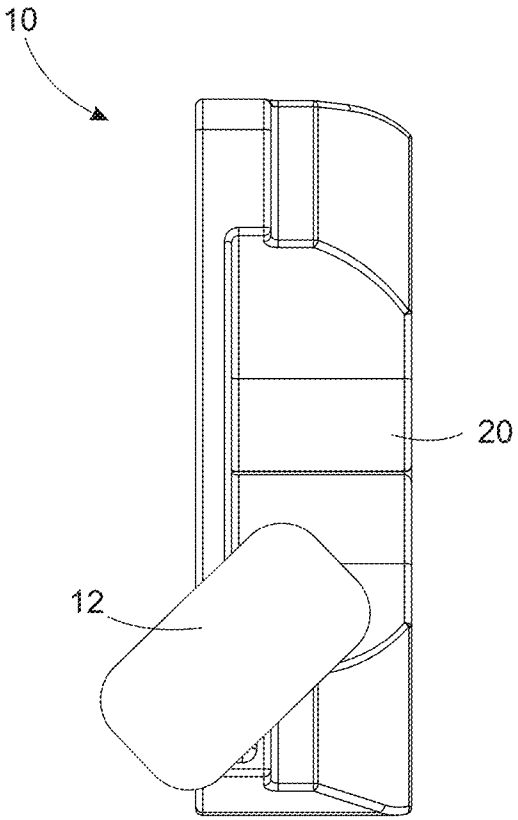
FIG. 14A is a top view of a golf club with an adjustable golf club grip according to an embodiment.

In some embodiments, as shown in FIG. 12, the first and second members 14 and 16 may be structural elements, within the grip cover 19. The golf club grip 12 may then be maintained on the golf club shaft 18 for the golfer to utilize during play. In some embodiments, the customized grip includes fixing the first and second grip members 14 and 16 in a configuration wherein they cannot be moved again. Additionally, the custom golf club grip may be fixed to the golf club in a user-desired orientation with respect to the golf club head. This may be particularly useful for golfers to adjust the grip orientation to the desired swing path or stroke. The orientation may further be selected to accommodate medical conditions and range-of-motion limitations. Medical conditions may include past or current injuries, chronic conditions directed to anatomical structures of the golfers, and the like. For example, as shown in FIGS. 13-14B, a golfer may have a chronic condition, such as a back condition or other part of the golfer's physiology or an injury that causes pain to the golfer utilizing a particular hand position on the grip and performing a normal swing. The custom grip may account for this by orienting the hands in a particular position and/or then further orienting the custom grip in a particular orientation with respect to the head of the golf club.

Further, the customized golf club grip may include customizing the sizes of the upper grip portion and the lower grip portion, wherein one or the other is larger in diameter than the other portion, or it may be a tapered custom golf club grip. Further, the custom grip or grip cover may include differing textures as selected by the golfer.

Figure 16:
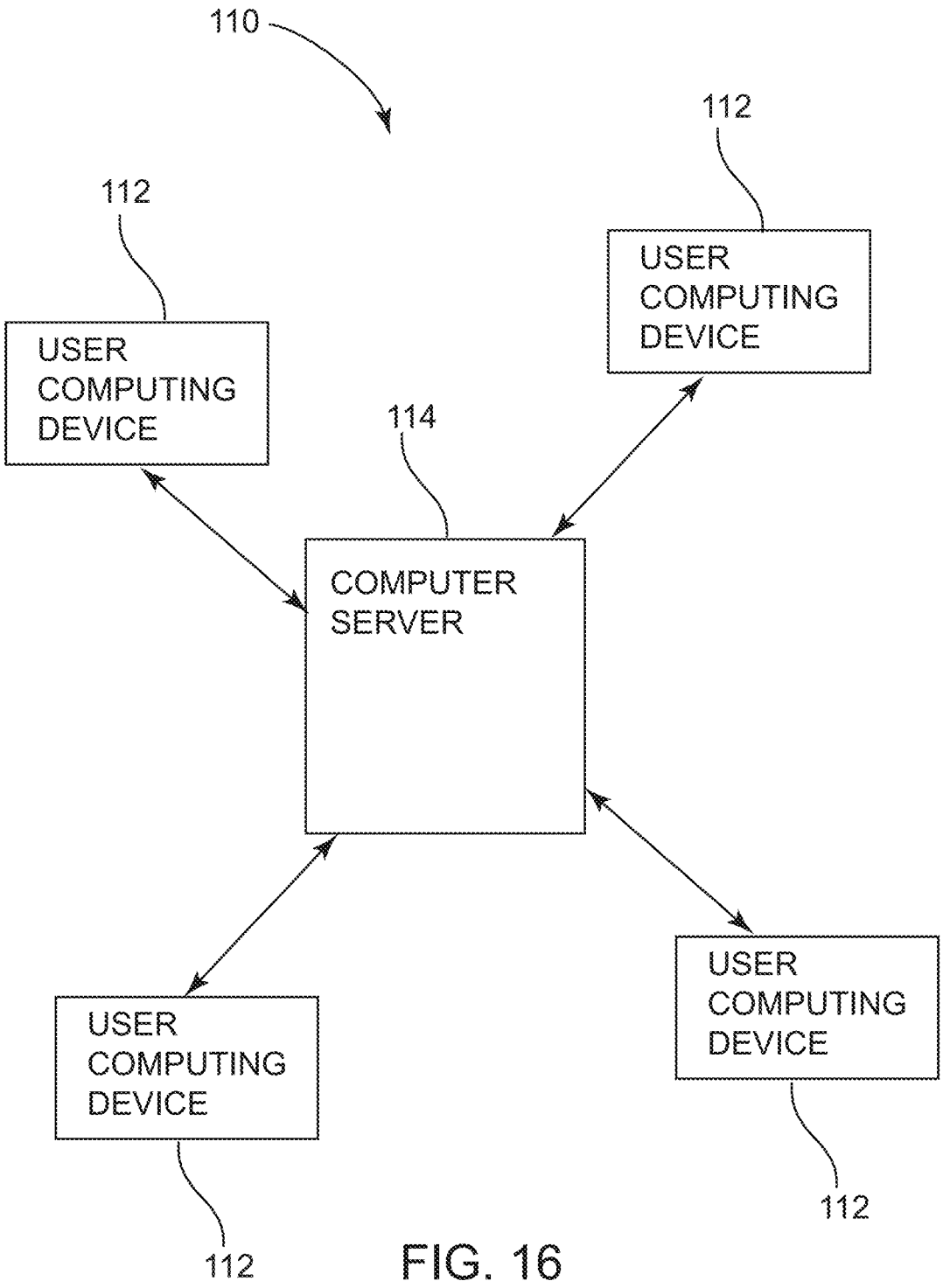
FIG. 16 is a diagrammatic view of a system for automatically and remotely creating a customized golf grip according to an embodiment.

Referring to the drawings, FIG. 16 depicts an embodiment of a customized golf grip system 110. The system 110 may include user computing devices 112 and a computer server 114, wherein the user computing devices 112 are coupled to the computer server 114. This coupling may be a network connection, such as through an Internet connection, wherein the user computing devices 112 may communicate with and receive communication from the server 114. The user computing devices 112 may be mobile computing devices, such as, but not limited to, smartphones, tablets, wearable technology and the like.

The computer server 114 may include a memory storing golf grip pressure information. The user computing device 112 may be coupled to the computer server 114, and, referring to FIG. 17A, the computer server 114 may be programmed to: receive from the user computing device 112 a signal having golf grip information, which may include measurements of the golfer obtained from the user computing device 112 (Step 120); automatically accumulate the golf grip information and aggregate the golf grip information within the memory to store the accumulated and aggregated information corresponding to the user (Step 121); automatically process the aggregated golf grip information and create a virtual customized golf grip corresponding to the aggregated golf grip information specific to the golfer (Step 122); and send the virtual customized golf grip to a manufacturer for forming the customized golf grip (Step 123).

For example, Step 120 may be accomplished using a user computing device 112 to obtain certain measurements of the golfer using a camera operably coupled to the user computing device 112. The user computing device may access the server through a web application or through a mobile application that provides a user interface and means of inputting data that is then sent to the server for processing and then receives data from the server to display to the user. In these embodiments, the server may include artificial intelligence that can accurately determine the hand orientation of the golfer without the need for a golfer to utilize an adjustable golf grip to determine any pronation or supination of grip portions corresponding to any pronation or supination of the golfer's hands.

Figure 15A:
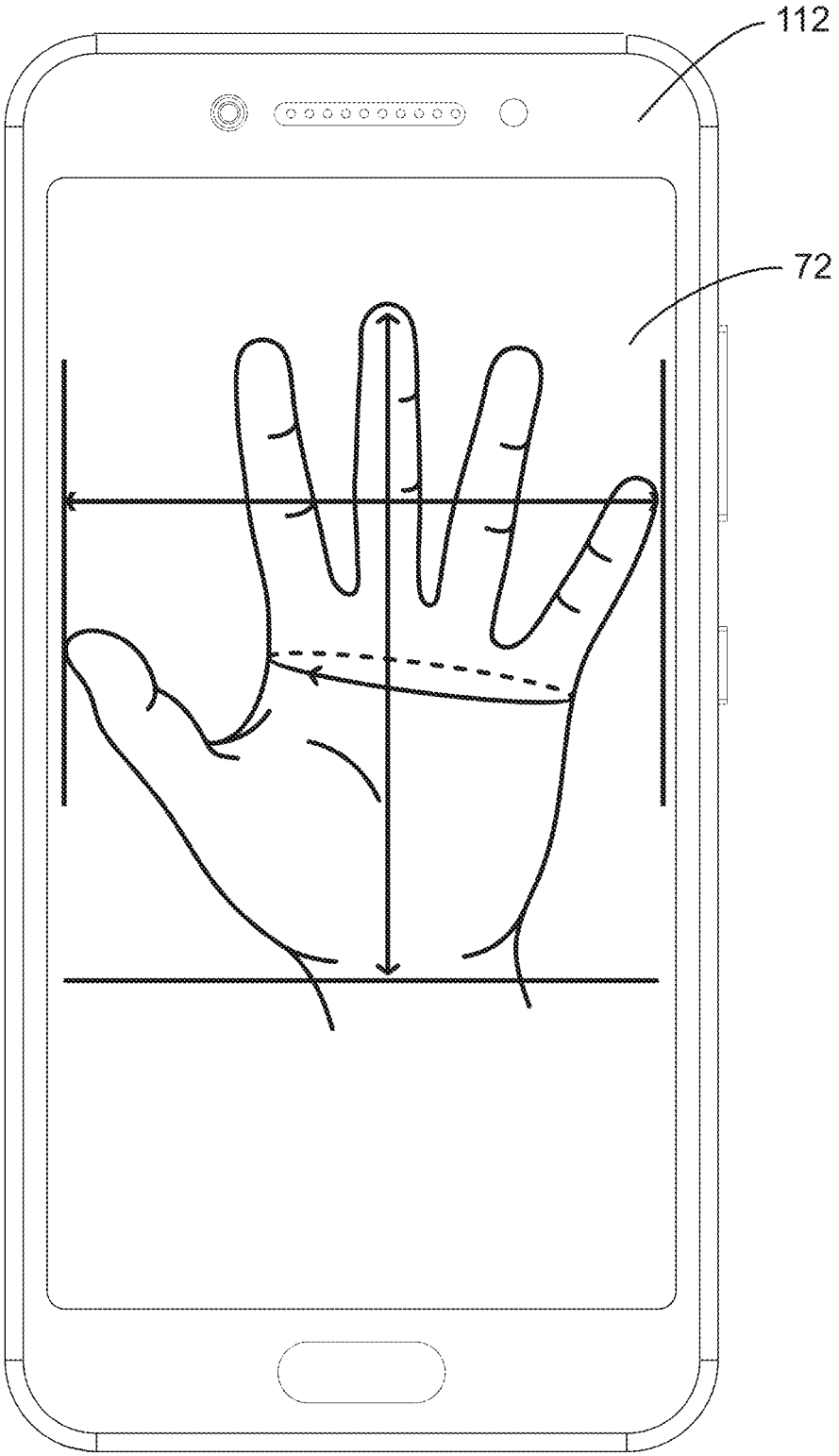
FIG. 15A is a front view of a mobile computing device utilizing a camera to measure a left hand of a golfer according to an embodiment.
Figure 15B:
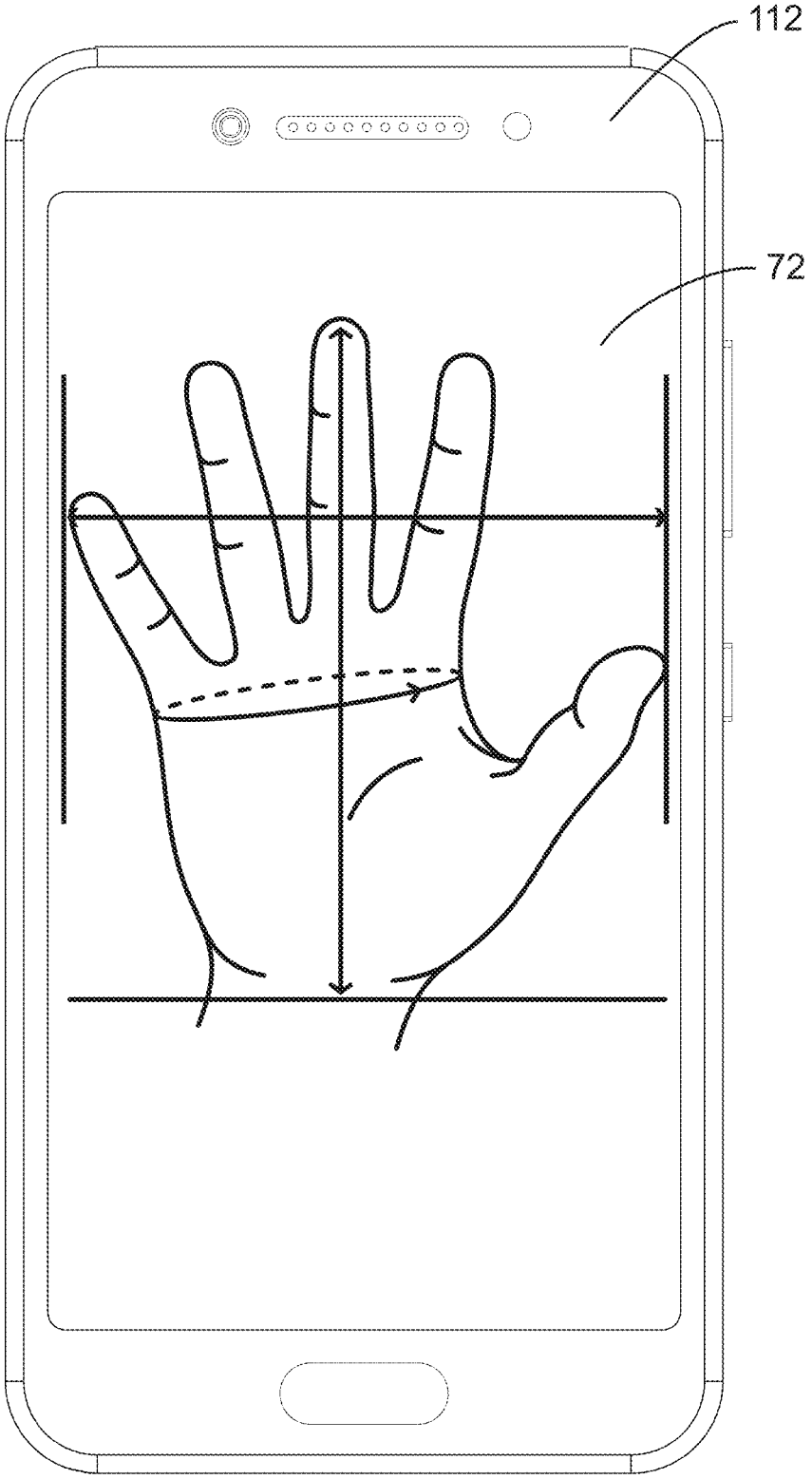
FIG. 15B is a front view of a mobile computing device utilizing a camera to measure a right hand of a golfer according to an embodiment.
Figure 15C:
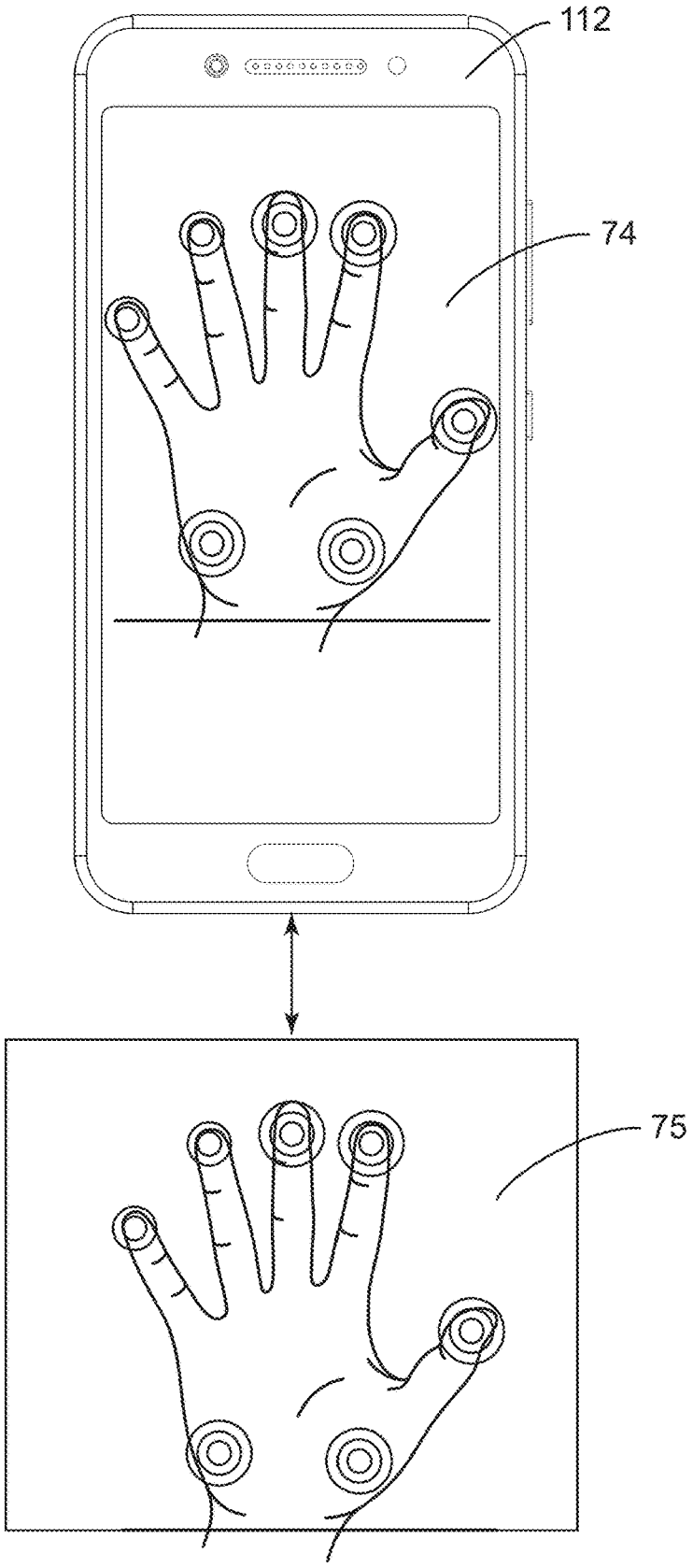
FIG. 15C is a front view of a mobile computing device coupled to a pressure plate to measure a pressure applied to the plate from a right hand of a golfer according to an embodiment.
Figure 15D:
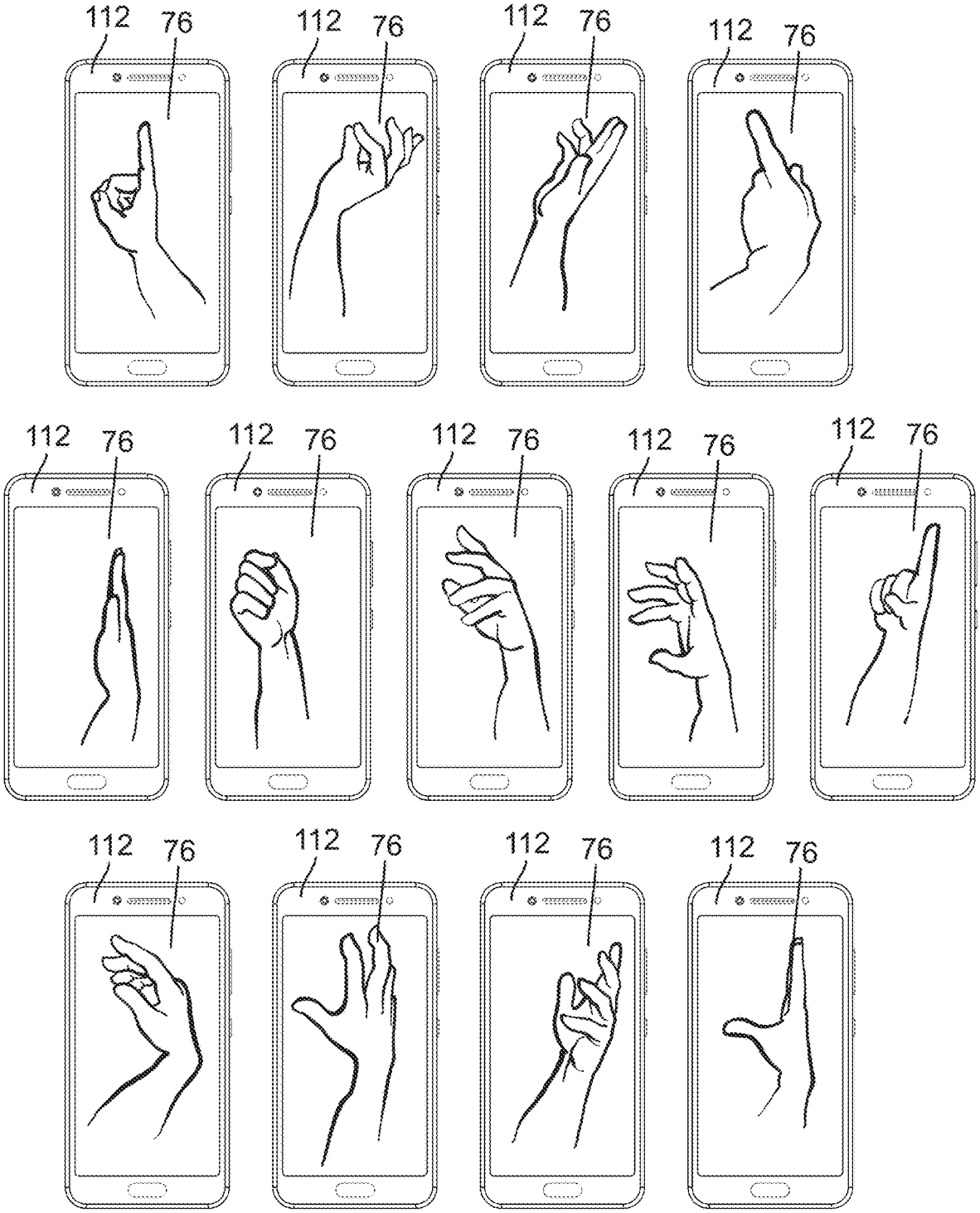
FIG. 15D depicts front views of a mobile computing device taking different measurements and capturing data associated with various positions of the hand of a golfer according to an embodiment.
Figure 15E:
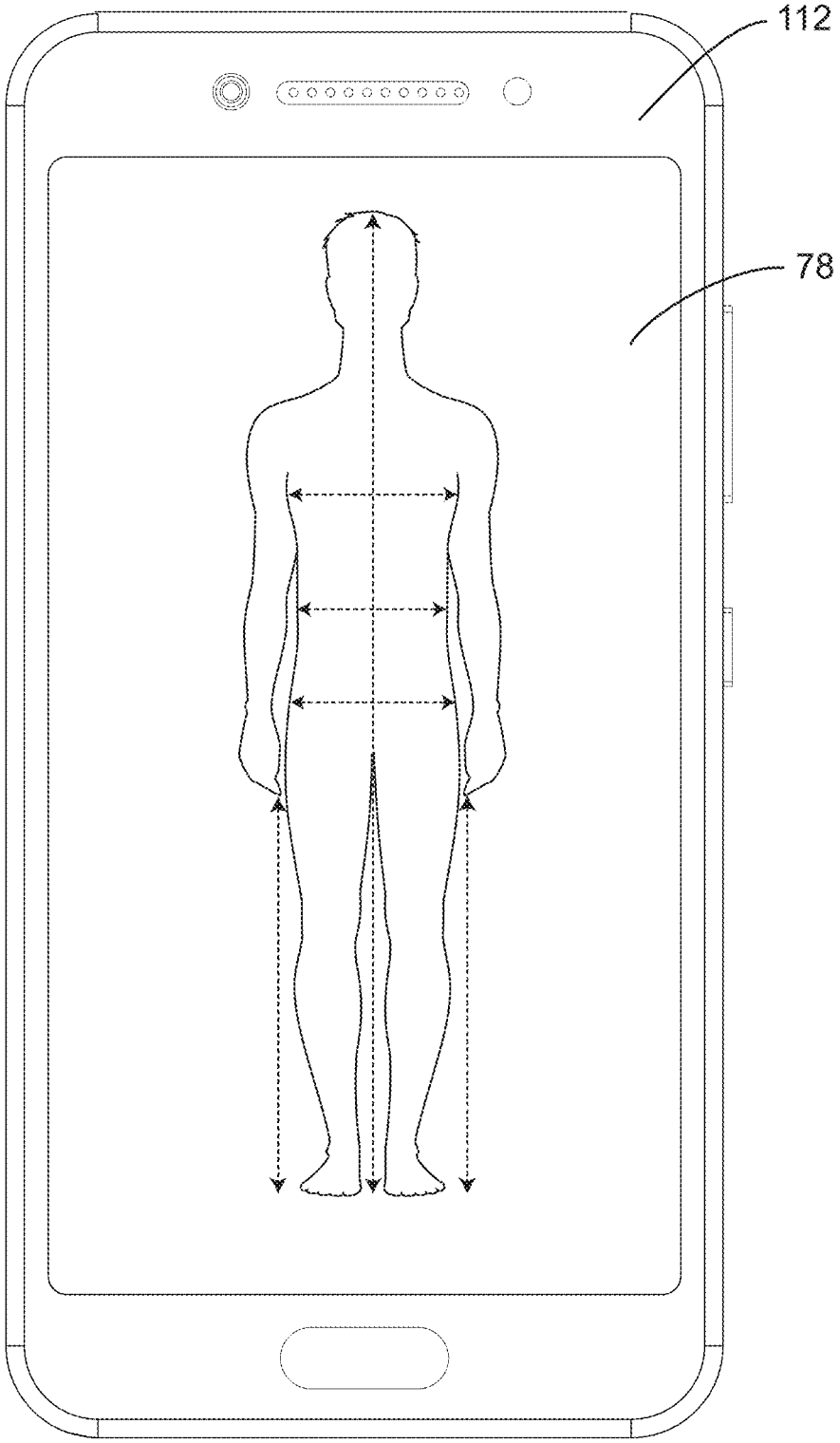
FIG. 15E is a front view of mobile computing device utilizing a camera to measure a front view of a body of a golfer according to an embodiment.
Figure 15F:
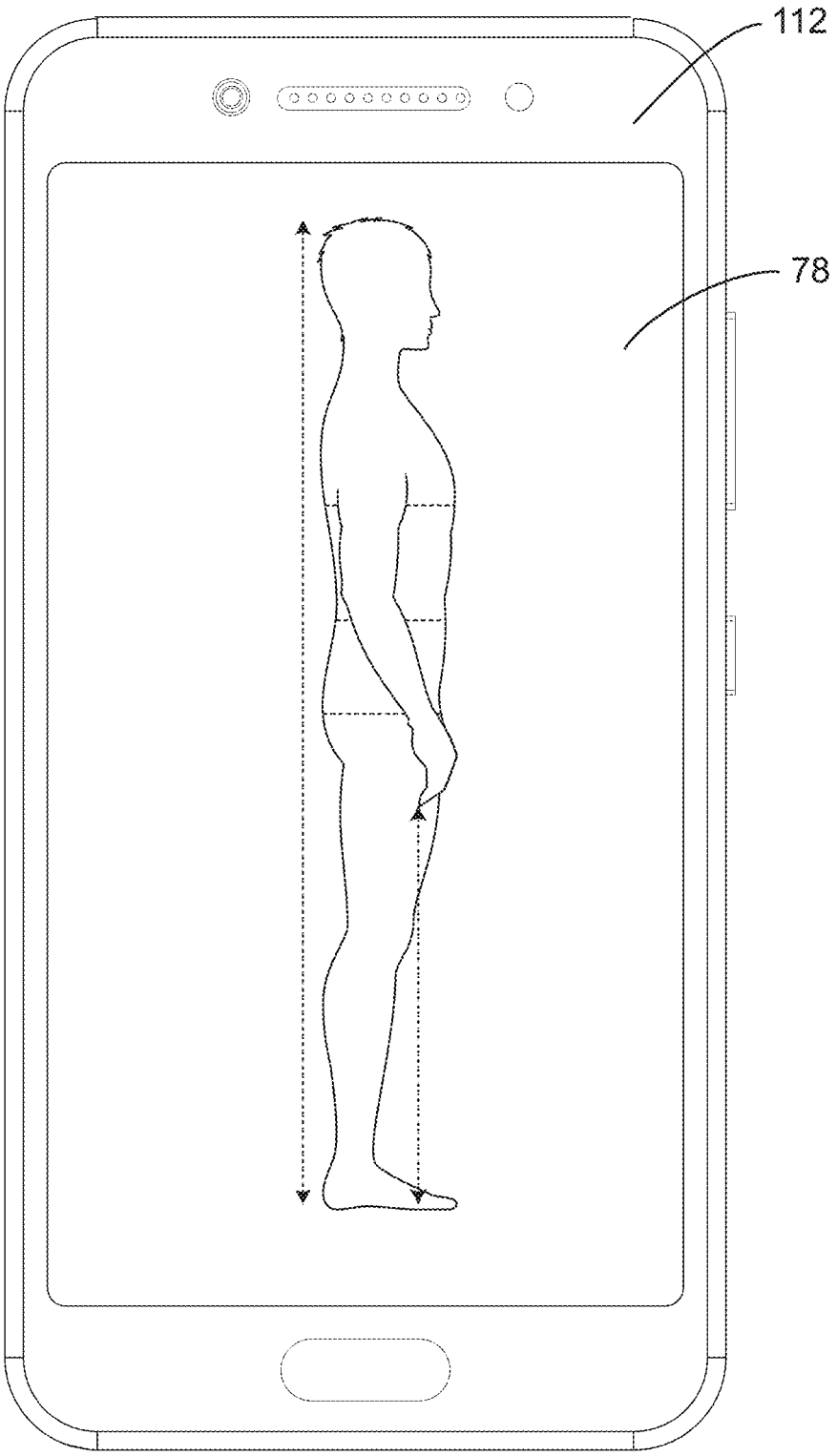
FIG. 15F is a front view of mobile computing device utilizing a camera to measure a side view of a body of a golfer according to an embodiment.
Figure 15G:
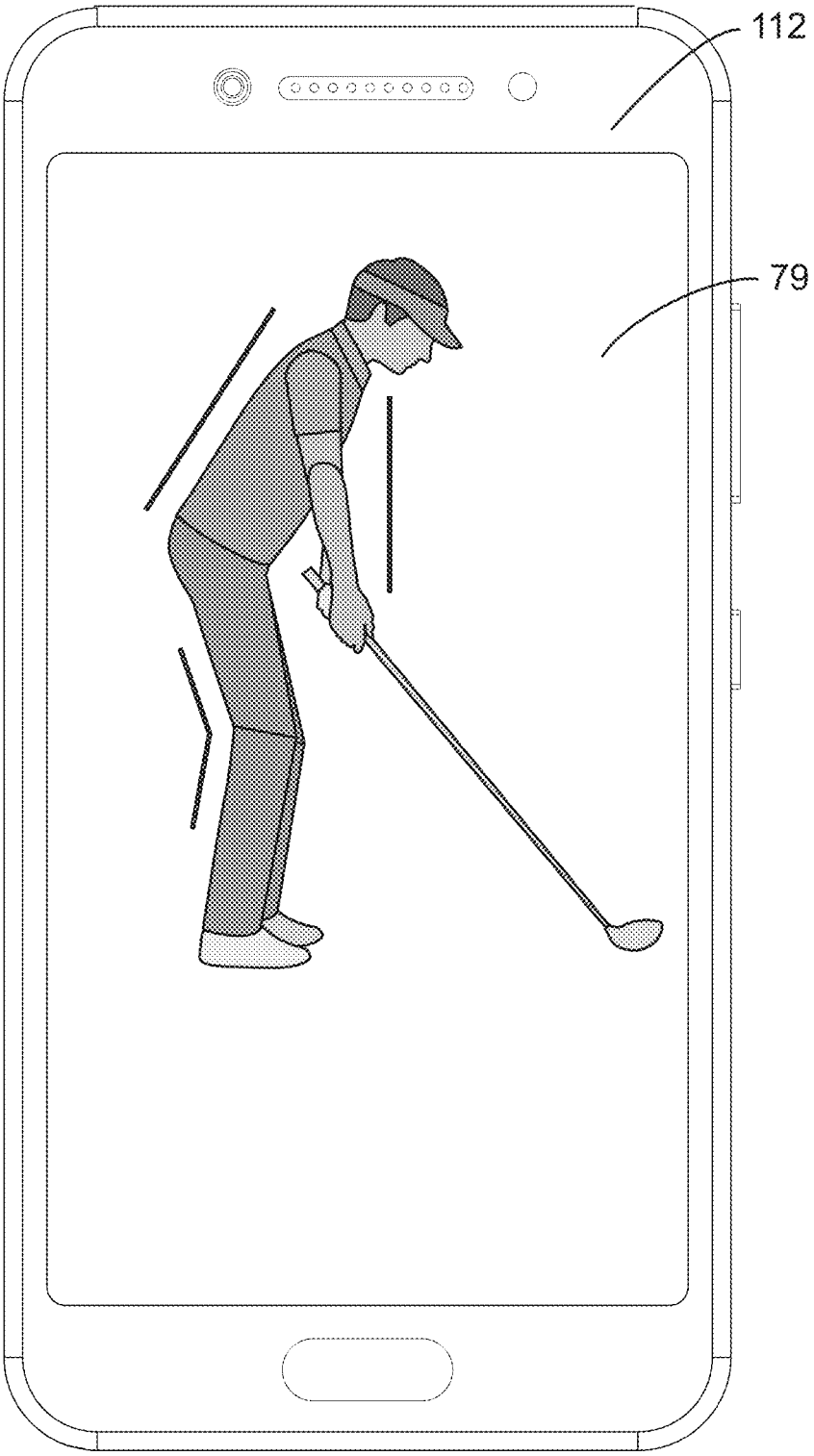
FIG. 15G is a side view of a mobile computing device utilizing a camera to measure a side view of a body of a golfer in a golf stance according to an embodiment.

For example, as depicted in FIGS. 15A-15G, the user computing device 112 may activate the camera coupled to the user computing device after the user computing device has established a network connection with the server. The camera may then capture, and the user computing device may calculate, various measurements of the golfer to obtain the golfer's unique grip anatomy. For example, and without limitation, FIGS. 15A-15D depict the user computing device 112 capturing and measuring the hands of the golfer with interfaces 72, 74 and 76. This may include not only the dimensions of the hands (see FIGS. 15A-15B) but also pressure applied by the hands with interface 74 shown in FIG. 15C and range of motion orientations as shown in interface 76 depicted in FIG. 15D. With regard to pressure of the hands, as depicted in FIG. 15C, a pressure plate or pressure input device 75 may be utilized wherein the pressure device is coupled to the user computing device 112 such that the pressure measured from the pressure device 75 is sent to and recorded by the user computing device 112 to use in the system 100. FIGS. 15E-15G depict the user computing device 112 capturing and measuring the golfer's body, arms, and body angles of the golfer performing a golf swing, and provide the video and/or still images to the server, wherein the server is programmed to measure the anatomical measurements of the golfer and accurately and virtually model a likely most comfortable and natural customized grip orientation of a first grip portion and a second grip portion utilizing interfaces 78 and 79. This virtual model may then automatically be sent to a grip manufacturer to create and form the customized golf club grip. The customized golf club grip may then be coupled to a golf club shaft for use by the golfer.

Further, referring again to FIG. 17B, the computer server 114 may be programmed to receive from the user computing device 112 a signal having golf grip pressure information, which may include pressure data obtained through a smart grip communicatively coupled to the user computing device 112 (Step 130); automatically accumulate the golf grip pressure information and aggregate the golf grip information within the memory to store the accumulated and aggregated information corresponding to the user (Step 131); automatically process the aggregated golf grip pressure information and create a virtual customized golf grip corresponding to the aggregated golf grip pressure information specific to the golfer (Step 132); and send the virtual customized golf grip to a manufacturer for forming the customized golf grip (Step 133).

Figure 17A:
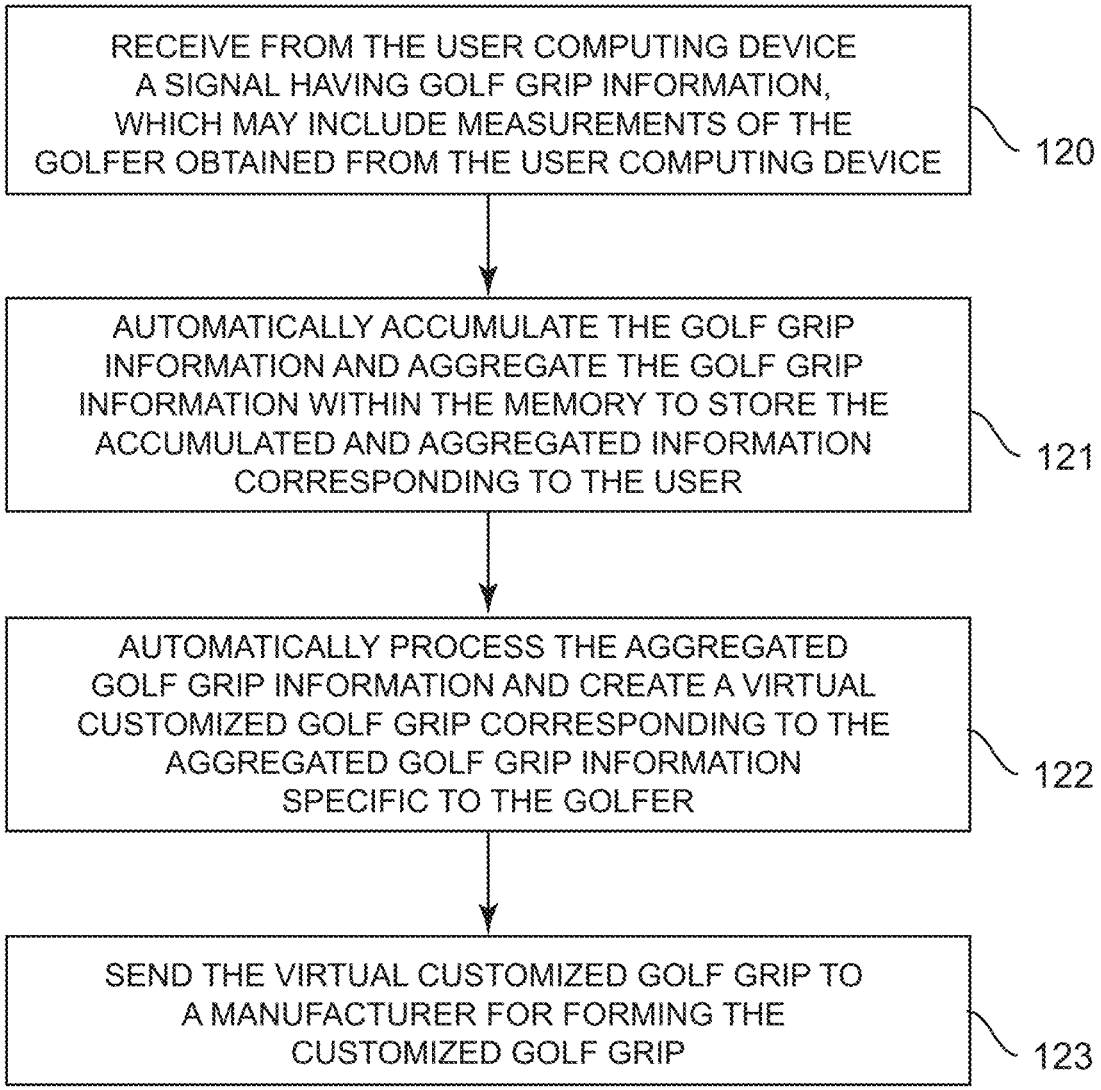
FIG. 17A is a flow chart of programmed instructions of a server of a system for automatically and remotely creating a customized golf grip according to an embodiment.
Figure 17B:
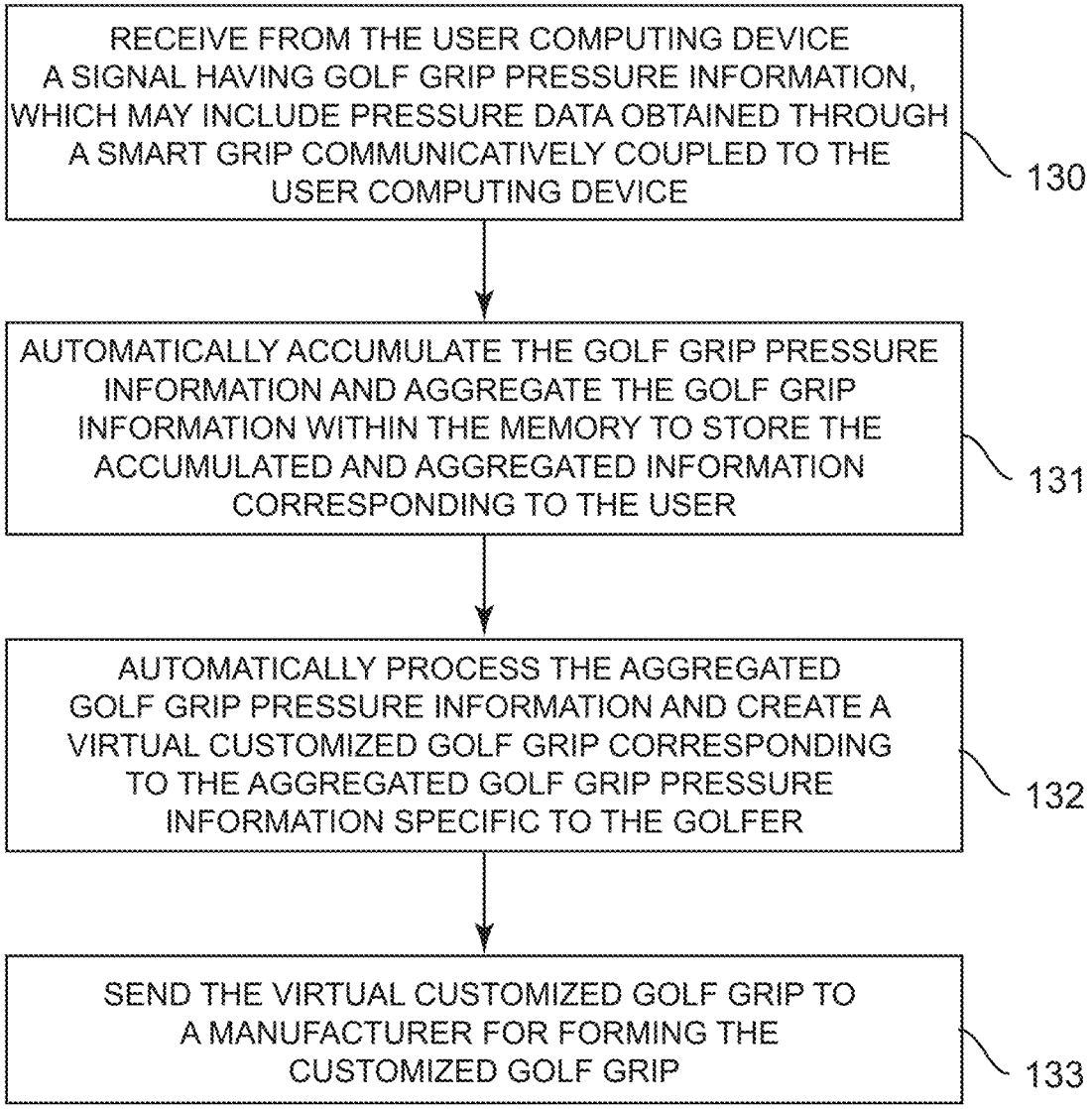
FIG. 17B is another flow chart of programmed instructions of a server of a system for automatically and remotely creating a customized golf grip according to an embodiment.

It will be understood that the computer server 114 may be programmed to perform the functions of FIGS. 17A and 17B together utilizing the measurements of the golfer forming the golf grip information and the golf grip pressure information to form the customized golf club grip.

Additionally, as shown in FIGS. 19A-19H golf grip pressure data may be obtained from the smart grip 150 that includes sensors 154 embedded within the grip substrate 152 (See FIG. 19A) including pressure from multiple parts of the golfer's hand, including, without limitation, each finger, the palms, and other pressure points applied by the hands when gripping the smart grip. A smart glove (not shown) with sensors may be utilized with each hand as well. The smart grip, for example, may be used during a round of golf, or during practice, or on a training device.

Figure 19A:
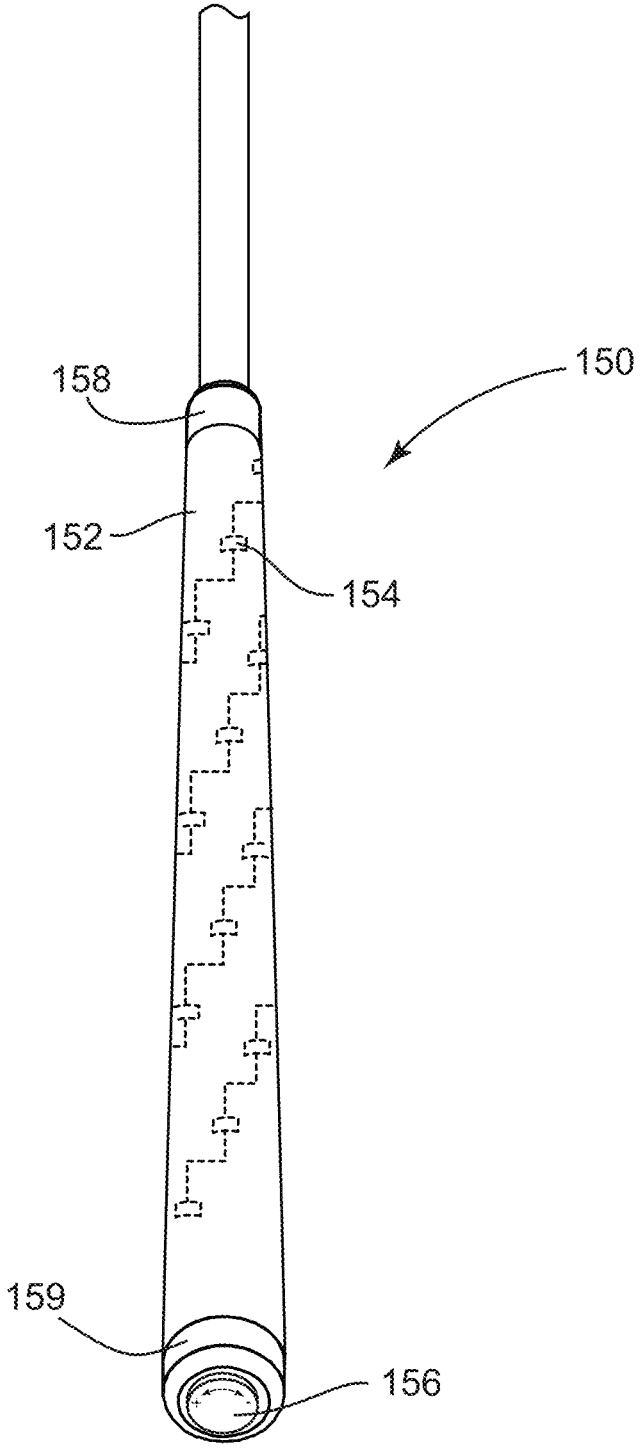
FIG. 19A is a perspective view of a golf grip with pressure sensors coupled to the grip or formed therein according to an embodiment.
Figure 19B:
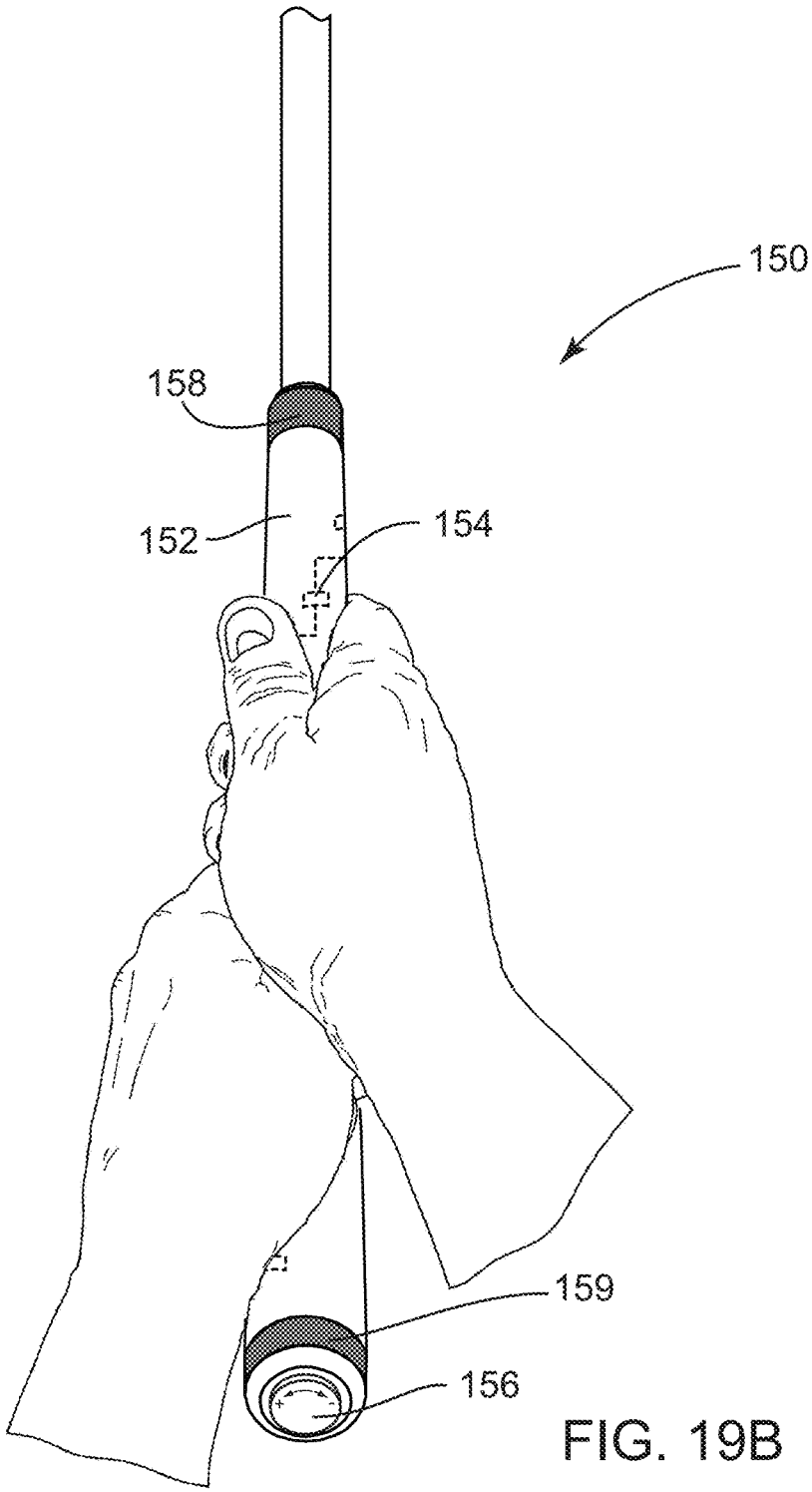
FIG. 19B is a perspective view of a golf grip with pressure sensors and visual indicators of pressure from both hands within an acceptable range according to an embodiment.
Figure 19C:
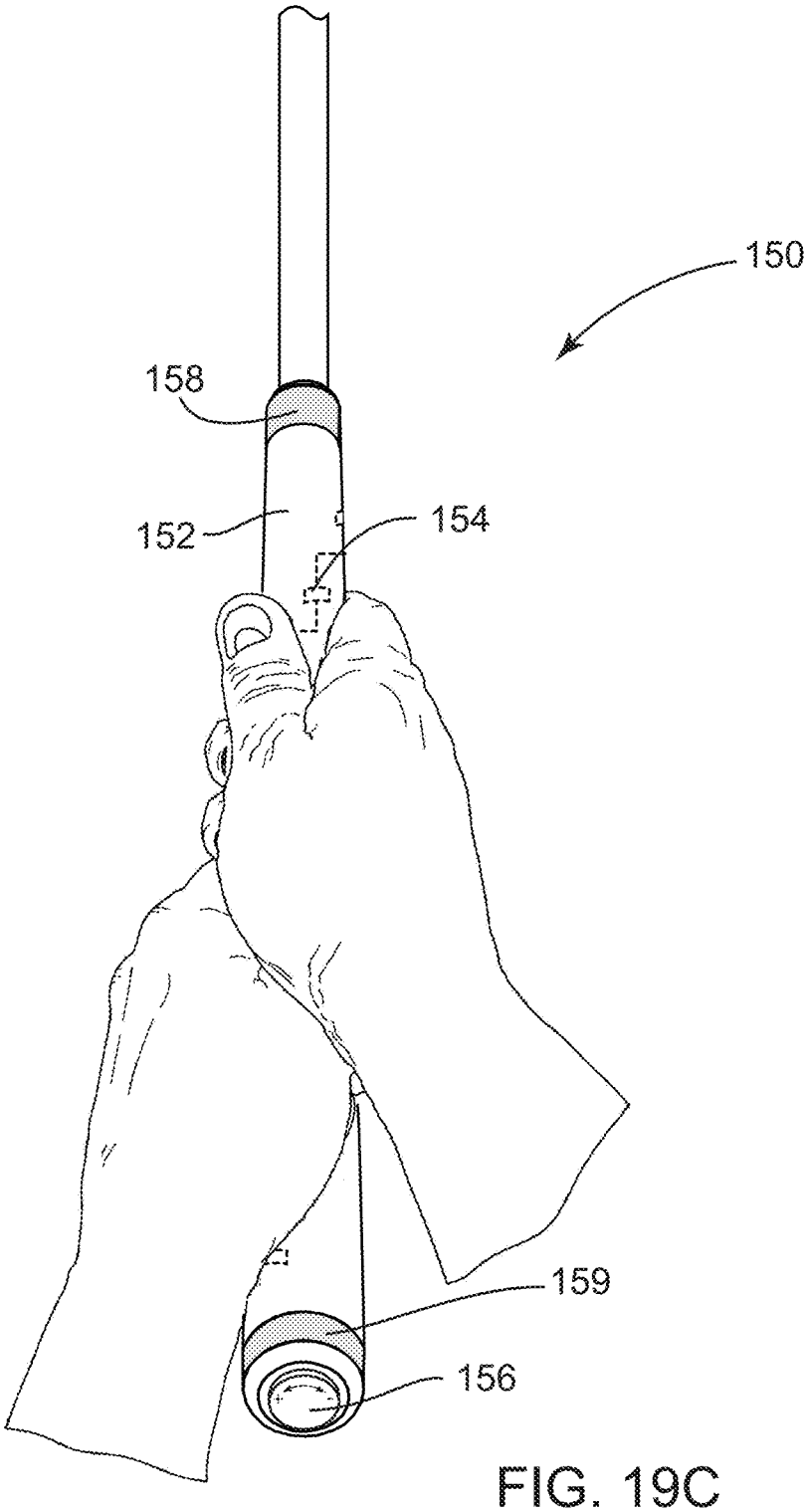
FIG. 19C is a perspective view of a golf grip with pressure sensors and visual indicators of pressure from both hands with a pressure less than the acceptable range according to an embodiment.
Figure 19D:
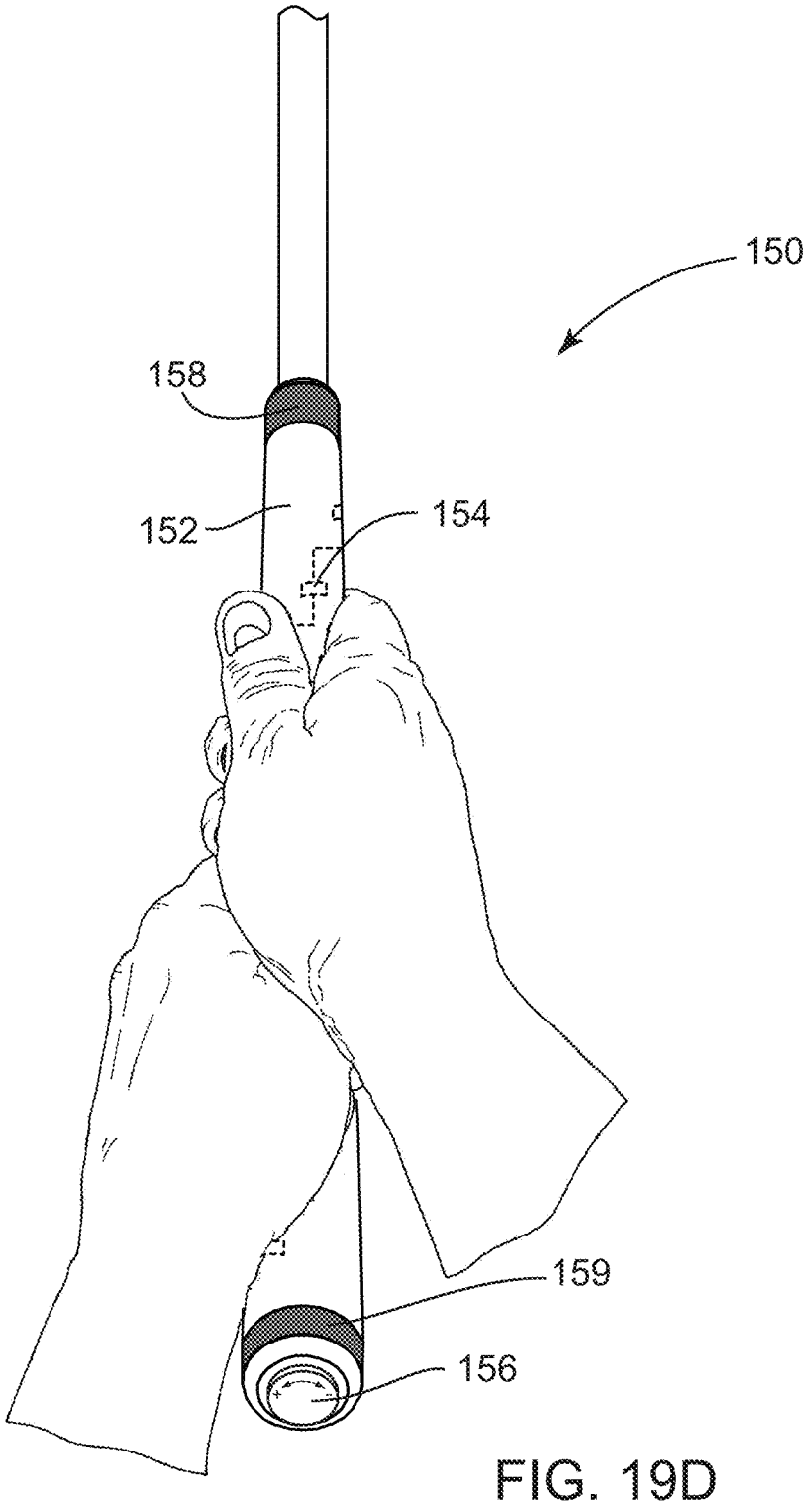
FIG. 19D is a perspective view of a golf grip with pressure sensors and visual indicators of pressure from both hands with a pressure greater than the acceptable range according to an embodiment.
Figure 19E:
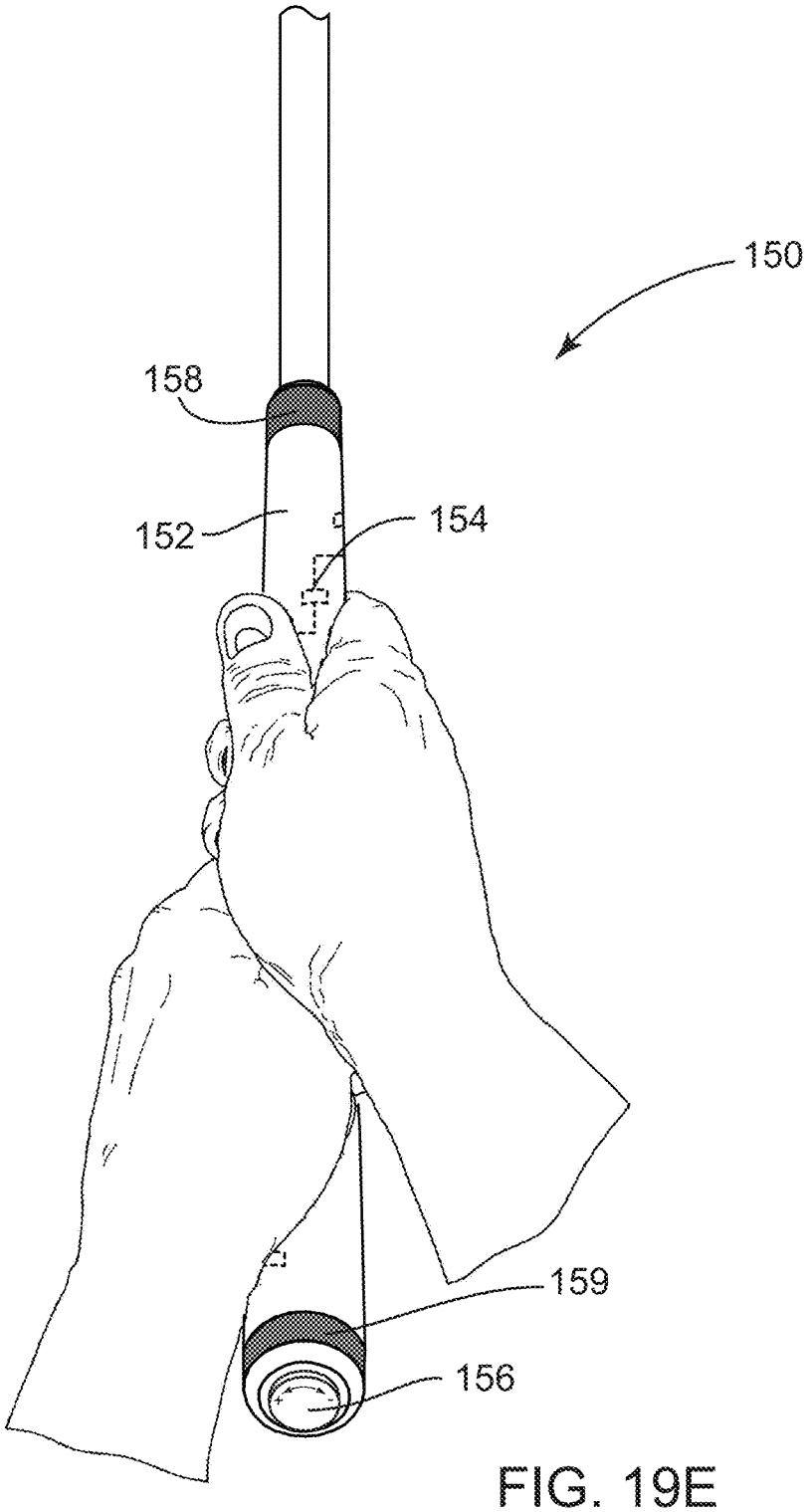
FIG. 19E is a perspective view of a golf grip with pressure sensors and a first visual indicator of pressure of one hand with a pressure greater than the acceptable range and a second indicator of pressure of the other hand within the acceptable range according to an embodiment.
Figure 19F:
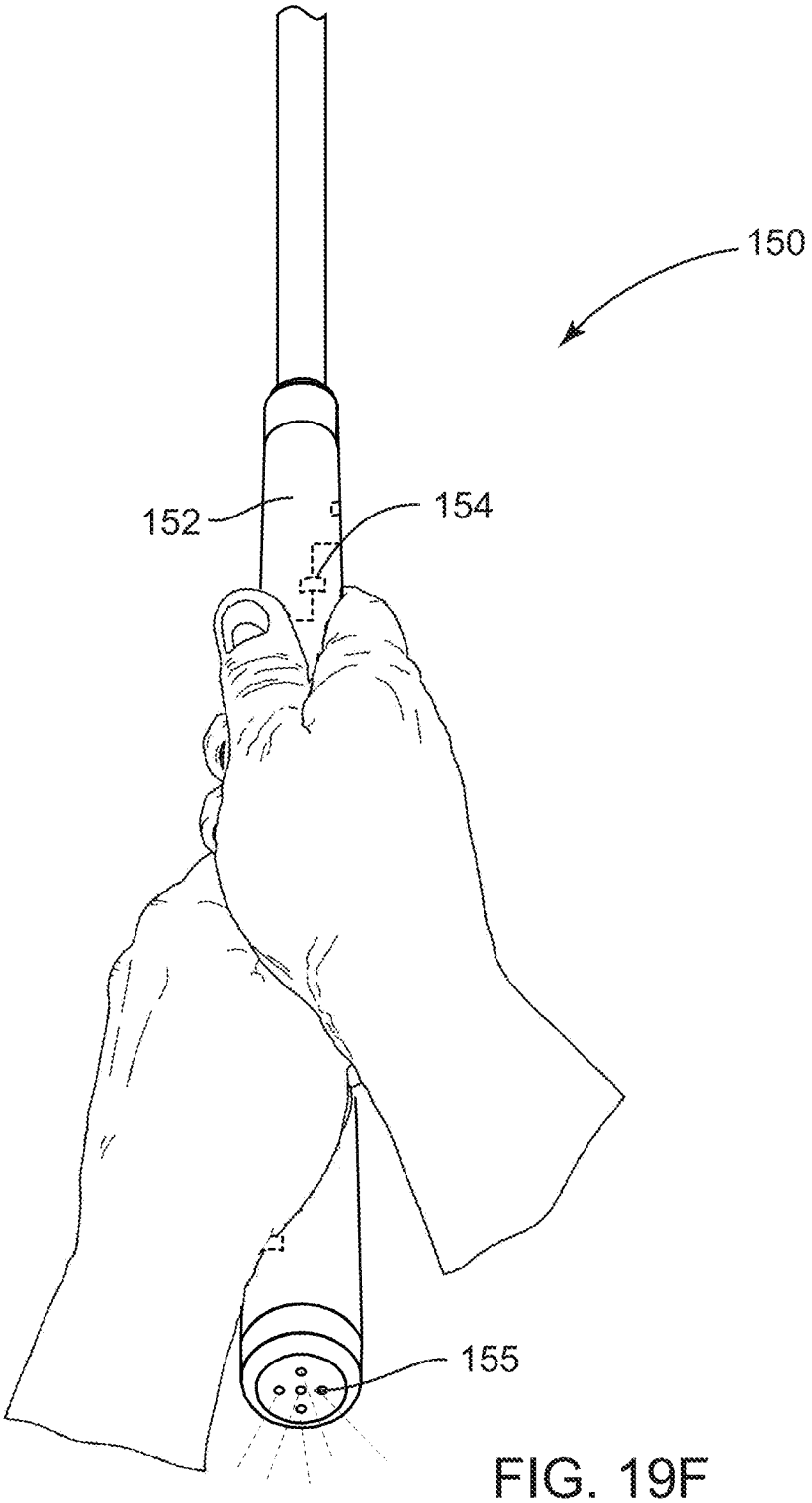
FIG. 19F is a perspective view of a golf grip with pressure sensors and an audible indicator according to an embodiment.
Figure 19G:
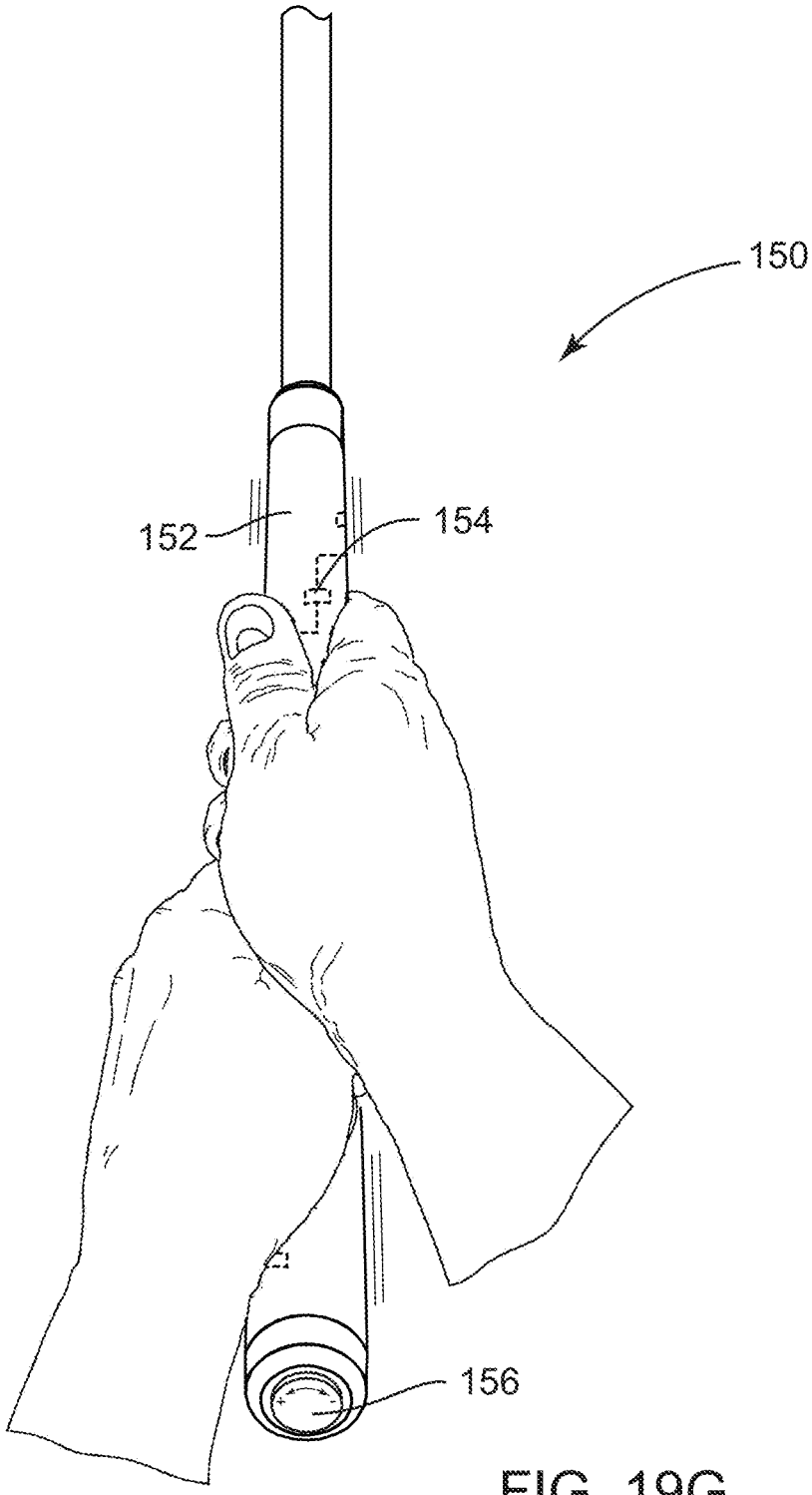
FIG. 19G is a perspective view of a golf grip with pressure sensors and a tactile feedback indicator according to an embodiment.
Figure 19H:
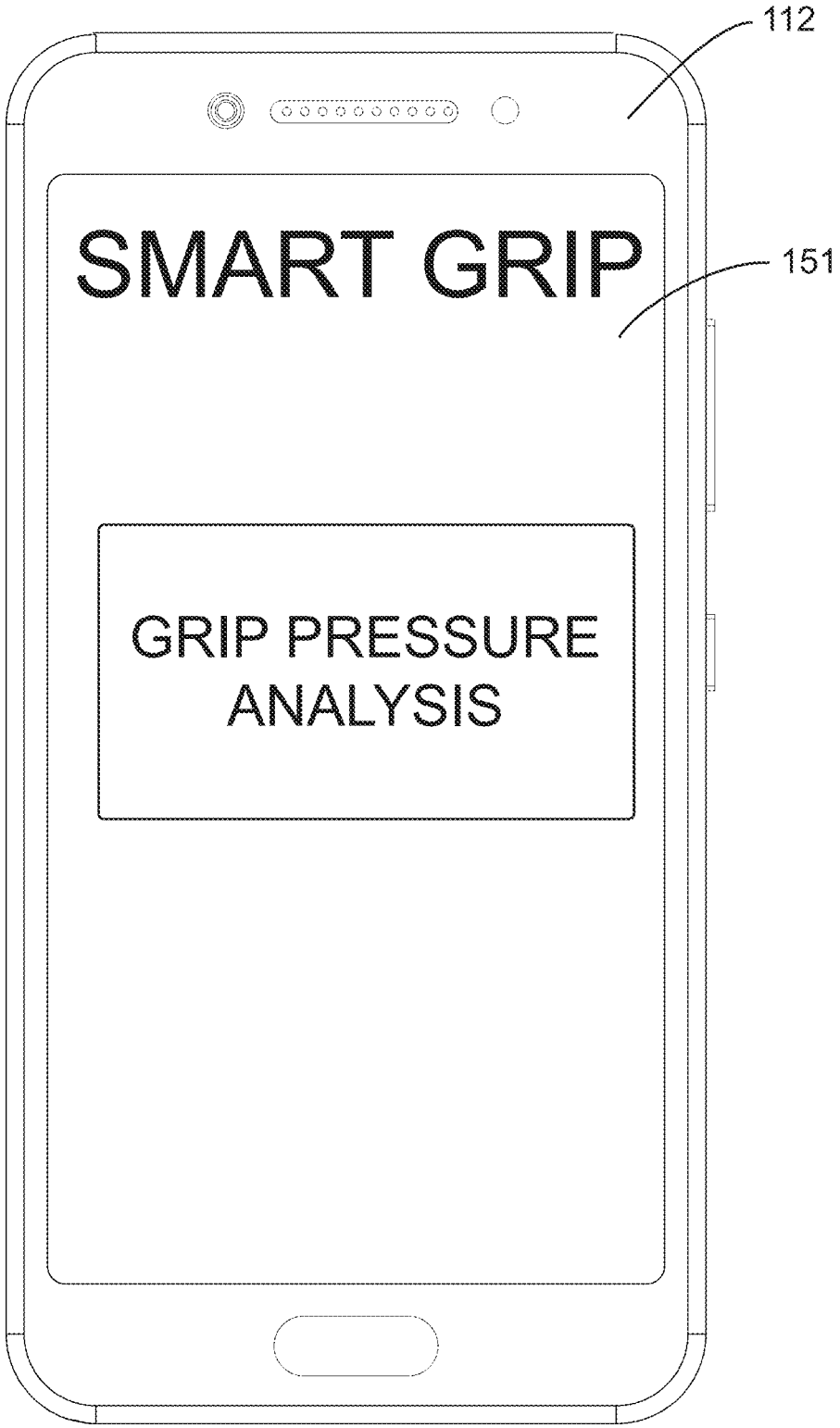
FIG. 19H is a view of a user computing device with a user interface to analyze stored grip pressure data according to an embodiment.

The pressure data, in the form of golf grip pressure information, may be saved in the server to create historical pressure data. The golfer may then be able to enter information into memory of the server to indicate the golf shot associated with the pressure data wherein the server can determine the pressure that resulted in the best result. Referring specifically to FIGS. 19B-19G the smart grip 150 may include a microprocessor that can be programmed from the user computing device to establish a pressure threshold range. The smart grip 150 may also include a pressure indicator 158 or 159 to notify the golfer of the pressure applied by his or her grip. The grip 150 may notify the golfer when the grip pressure is within the threshold range. For example, the indicator may be a visual indicator, such as a colored light, wherein the indicator is a green light if the pressure is within the proper pressure threshold range (see FIG. 19B); a yellow light if the pressure is less than the pressure threshold range (see FIG. 19C; and a red light if the pressure is greater than the pressure threshold range (see FIG. 19D). In some embodiments, there may be two visual indicators 158 and 159, wherein each indicator is associated with either the upper portion or the lower portion of the grip. The visual indicator may operate independently to determine if each hand of the golfer is within the pressure threshold range. For example, as shown in FIG. 19E, one hand may be within the pressure threshold range and utilize a green light to indicate such and then the other hand may be gripping pressure greater than the pressure threshold range and utilize a red light. The indicator may be audible device 155 providing a sound to determine that the pressure of the grip applied by the golfer is within the threshold range (see FIG. 19F). Another embodiment may include a tactile feedback system (see FIG. 19G), wherein the smart grip 150 applies vibratory feedback to the golfer to notify the golfer when the pressure is proper, such as no vibratory feedback when the pressure is accurate. This allows the user to adjust his or her golf grip pressure to the pressure of the golfer's most accurate swing. In these embodiments, the golf grip may include a dial 156 that allows the golfer to adjust the pressure threshold range, such as, but not limited to, increase or decrease the pressure threshold range.

The smart grip 150 may include a memory and a processor as part of the grip. Additionally, the smart grip may have a communication module, such as a WiFi device, a Bluetooth device, a wireless network connection such as 4G, 5G or the like that can send golf pressure data to a memory for storage, such as a server. The pressure data may further include tracking the pressure data for as much time as the user would like to track the pressure data, such as for an entire round of golf. The pressure data may include pressure data, and corresponding speed of the swing and club type. This data may be aggregated and used in a comparative nature. This allows the tracking of pressure changes over a round or practice session of golf. The system can track changes in pressure of the grip as the mental pressure mounts on a golfer during a round or tournament. It can track pressure changes through an entire golf swing, wherein the data includes pressure data through each phase of a swing. In some embodiments, the pressure data may include specific finger pressure or a grip pressure pattern. This allows a range of pressure patterns of the grip that can alert the golfer if his or her grip pressure is outside of the pressure range. This data may be provided in real time and, as depicted in FIG. 9H, may be available on a user computing device 112 such as smartphone connected to the memory storing the pressure data and allow the golfer to, in real time, analyze his or her grip pressure by selecting grip pressure analysis on interface 151 and make adjustments and view the adjustments from swing to swing based on the grip pressure analysis.

The system may also include storing data of certain grip pressure of certain professional golfers, wherein the golfer using the system can compare his or her pressure with that of certain professional golfers.

It should be appreciated that, in all embodiments of the present invention, the golf club shaft 18 at all times is maintained in a straight configuration and is not bent or twisted in any way, and embodiments are directed to the inventive golf club grip only.

Figure 18A:
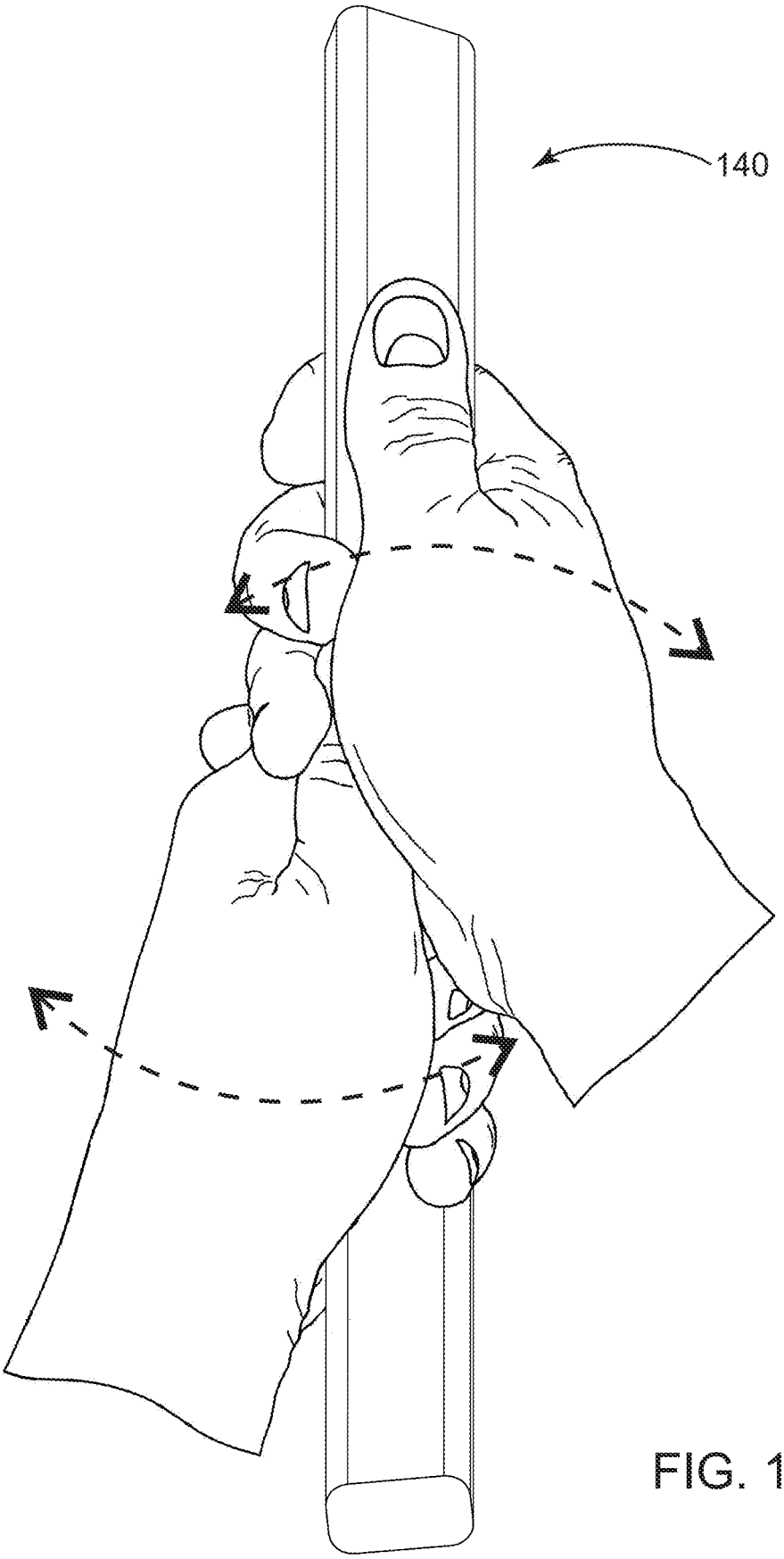
FIG. 18A is a perspective view of a grip mold with a golfer grasping it for customizing the pronation and supination of a golfer's hands for creation of a custom golf grip according to an embodiment.
Figure 18B:
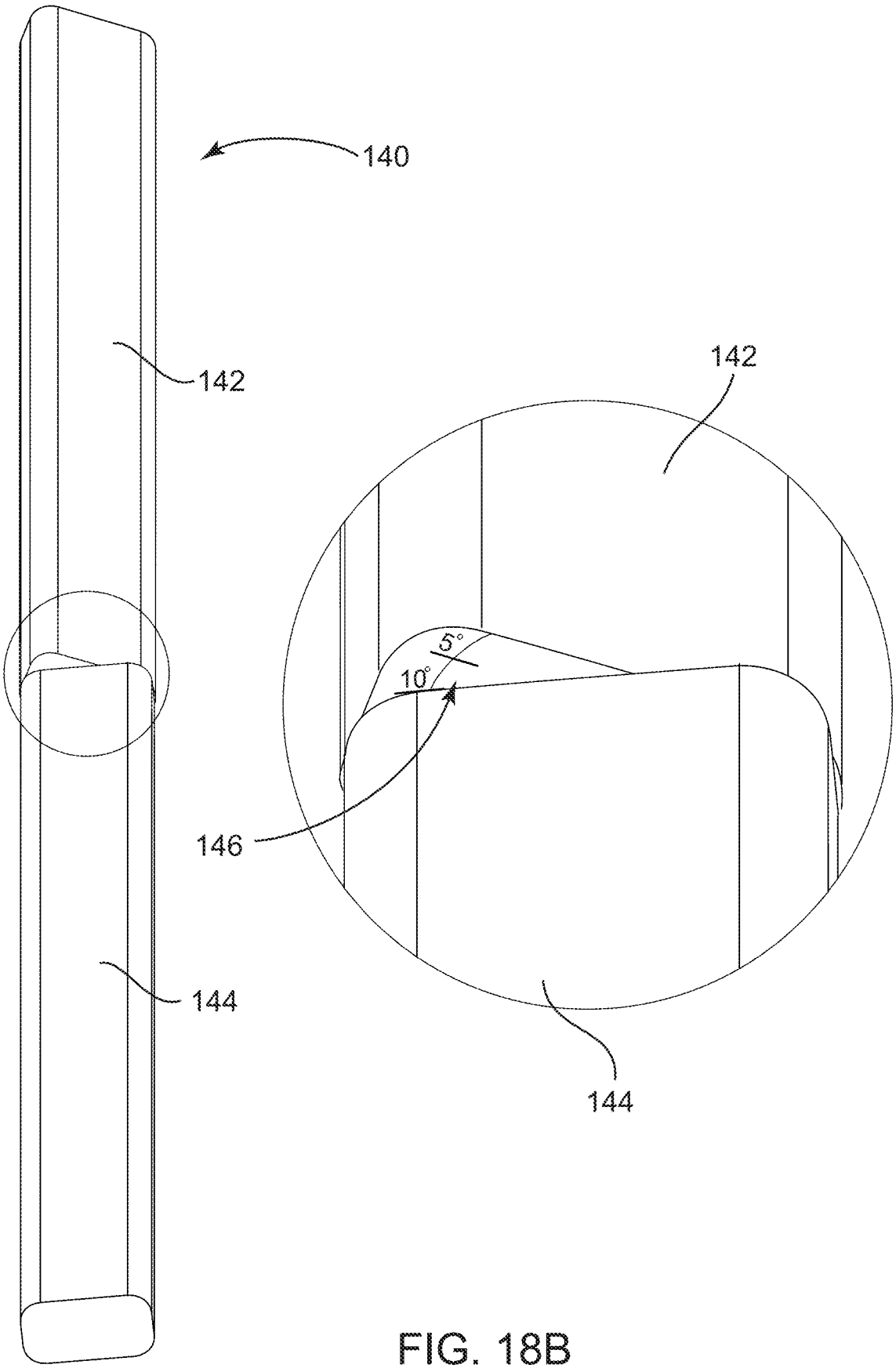
FIG. 18B is a perspective view of a grip after a golfer has held the grip mold and pronated and or supinated either or both of the golfer's hands according to an embodiment.

Referring to the drawings again, FIGS. 18A-18B and 20A-20C depict the utilization of a mold 140 to create a custom golf grip. FIGS. 18A-18B depict a golfer that grasps a grip mold 140 and then pronates or supinates each hand with respect to the other and rotates a first grip portion 142 to a different angle 146 from the second grip portion 144. The golfer may remove his or her hands and the mold 140 is maintained in the orientation of the golfer's pronated or supinated positions. The angle 146 measure, with regard to the first and second grip portions 142 and 144, can be measured, such as, without limitation, by using an inscribed angle measurement 146 on the first grip portion 142, as shown in FIG. 18B. The mold 140 may then be sent to the manufacturer to create a golf club grip customized to the mold 140 prepared by the golfer.

Figure 20A:
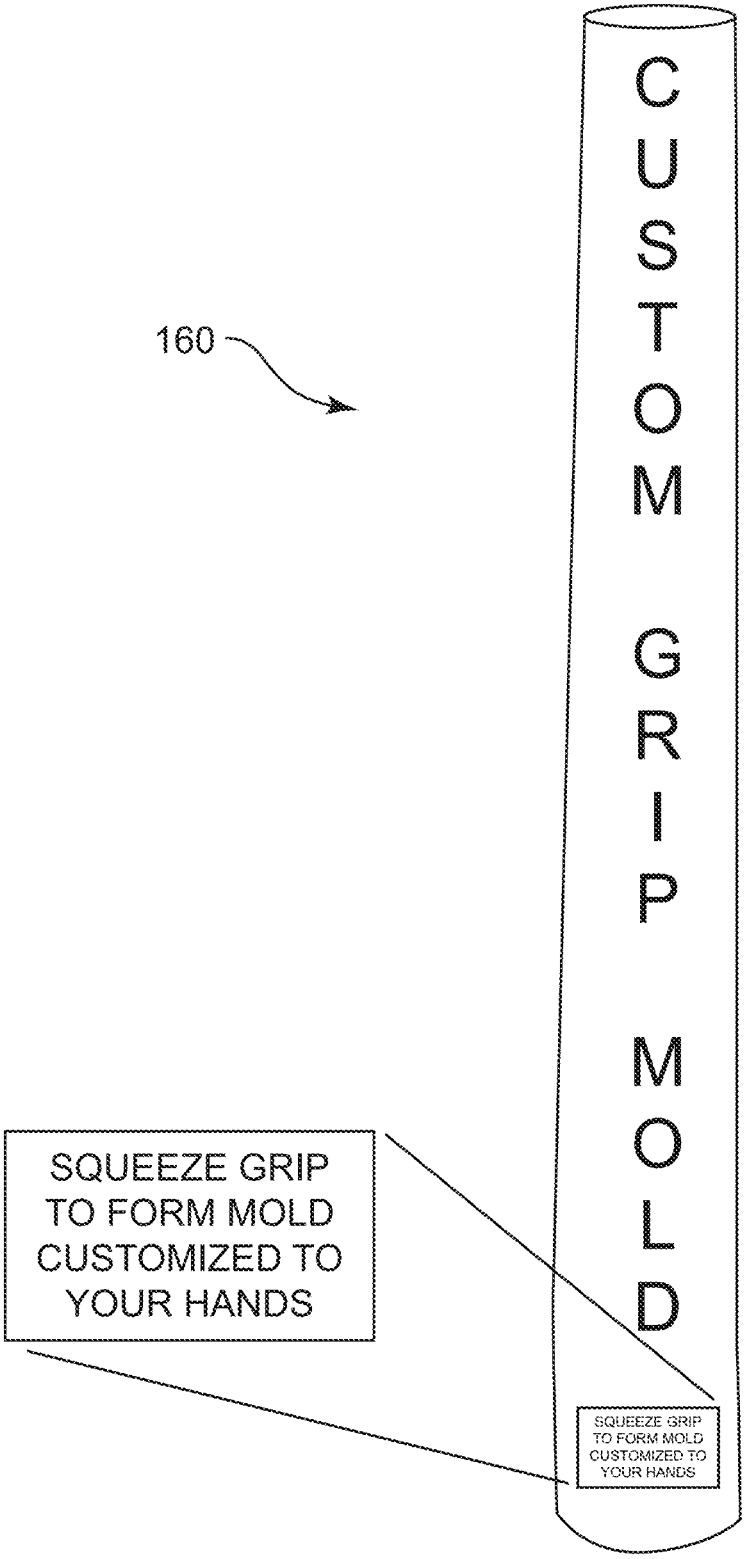
FIG. 20A is a side view of a custom grip mold according to an embodiment.
Figure 20B:
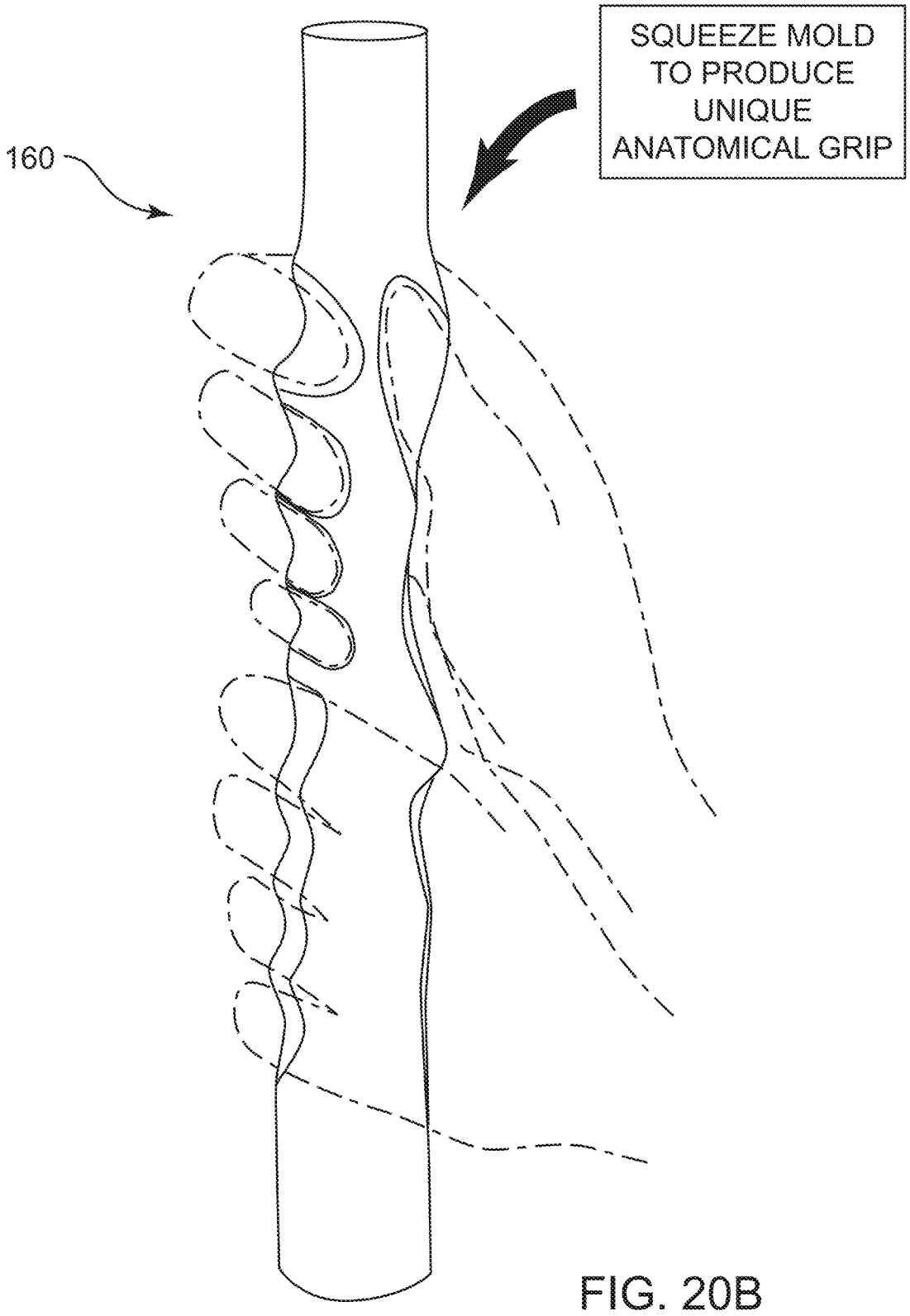
FIG. 20B is a side view of the custom grip mold of FIG. 20A with hands of a golfer squeezing the grip mold according to an embodiment.
Figure 20C:
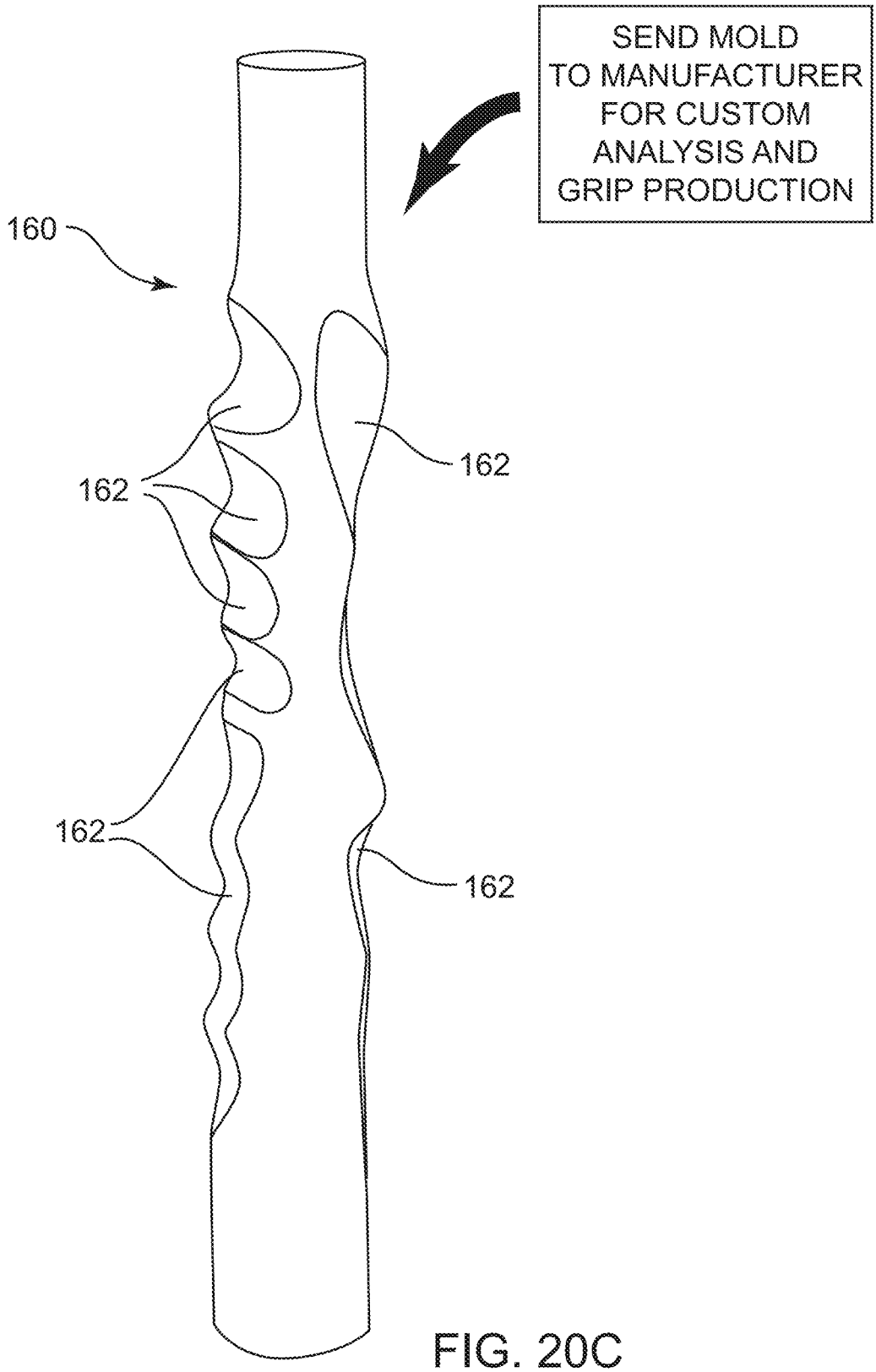
FIG. 20C is a side view of the custom grip mold of FIG. 20C showing the depressions made by the hands of the golfer squeezing the custom grip mold according to an embodiment.
Figure 20D:
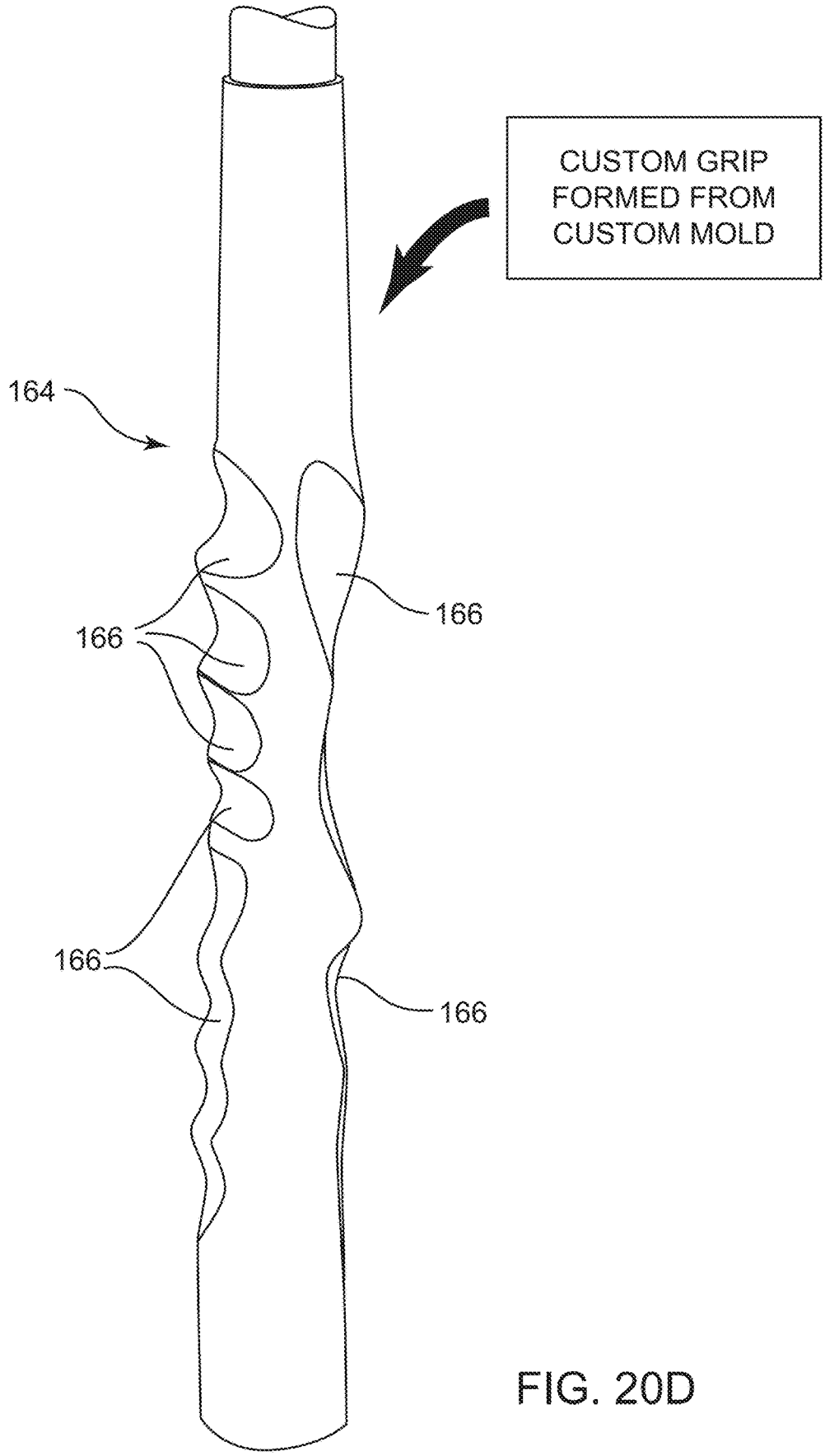
FIG. 20D is a side view of a customized golf grip formed from the custom grip mold of FIG. 20C showing the depressions corresponding to the hands of the golfer according to an embodiment.
Figure 20E:
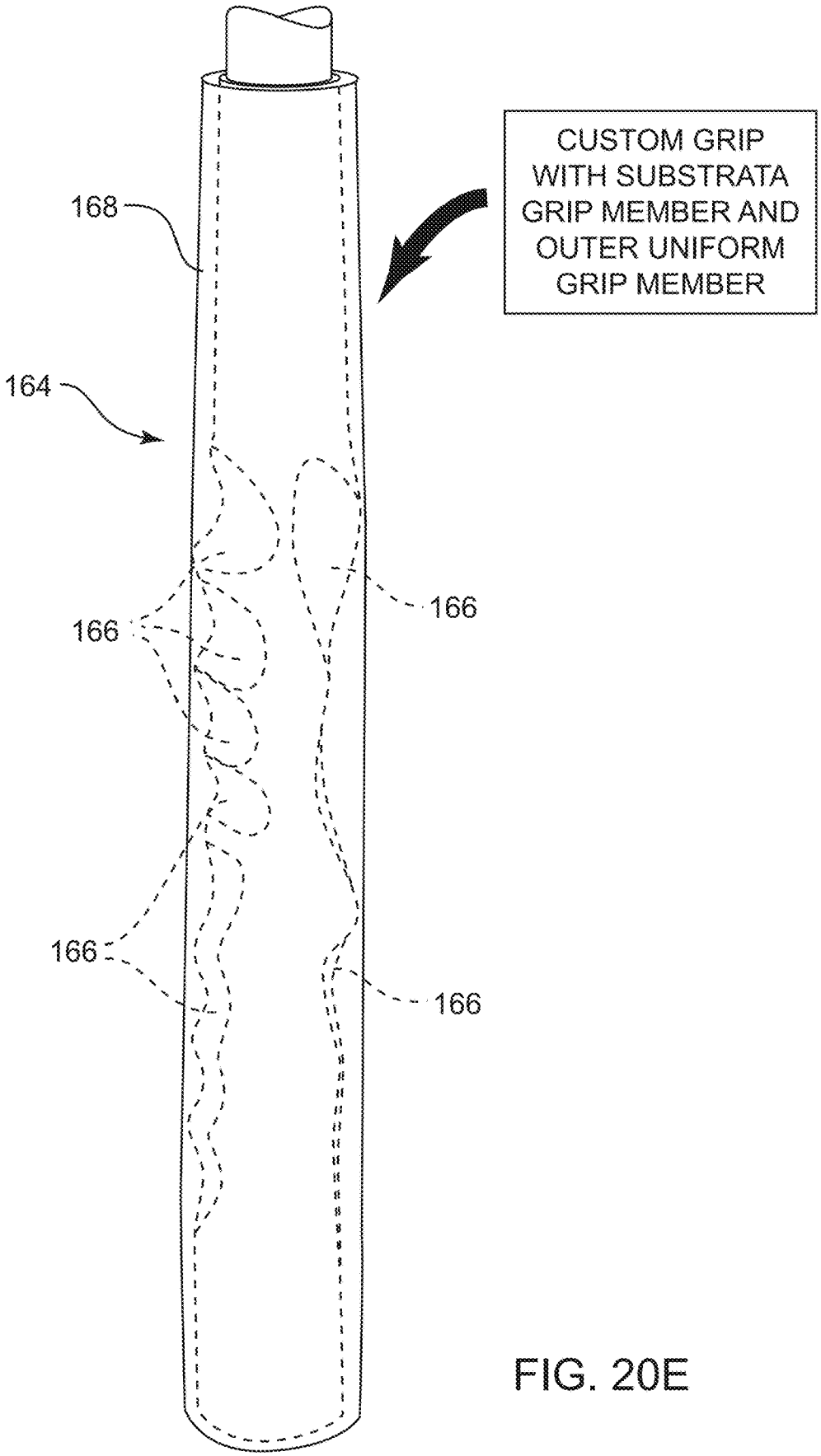
FIG. 20E is a side view of a customized golf grip formed from the custom grip mold of FIG. 20C showing a substrata grip member having depressions corresponding to the hands of the golfer and a uniform cover grip portion extending over the substrata grip member according to an embodiment.

FIGS. 20A-20E depicts another embodiment of utilizing a grip mold 160. The grip mold 160 may include the mold depicted in FIG. 20A, wherein the mold 160 may include instructions to squeeze the grip mold 160 to form a mold customized to the golfer's hands. The golfer squeezes the grip mold 160 as shown in FIG. 20B in order to produce a mold with a unique anatomical grip. The mold 160, shown in FIG. 20C, maintains the depressions 162 in the mold 160 and the mold 160 may be sent to the manufacturer for custom analysis and grip production. The grip analysis may include the various natural grip position of the hands and the various amounts of pressure made by different hand components when gripping the mold 160 and squeezing. The manufacturer may then produce a custom grip 164 (see FIG. 20D) with depressions 166 virtually identical in shape to the mold 160 depicted in FIG. 20C, which may be used by the golfer for play or for training. In another embodiment, the custom grip 164 may form a substrata grip member shown in broken lines, wherein the substrata grip member 164 is covered by a uniform grip member 168 (See FIG. 20E). The substrata member 164 may have different material to provide additional compressible material in the locations of the depressions created based on the mold, wherein the golfer may grip the custom golf grip 164 and squeeze, with the pressure typical for that golfer, and the compressible material operates to provide a more uniform pressure on the grip 164, considering the non-uniform pressure applied by the golfer during a typical grasping and squeezing the hands of the golfer when using a golf club. The outer uniform grip member provides a visual grip that is uniform as typical golf grips are, with the depressions having compressible material therein lying under the uniform grip member.

Figure 21A:
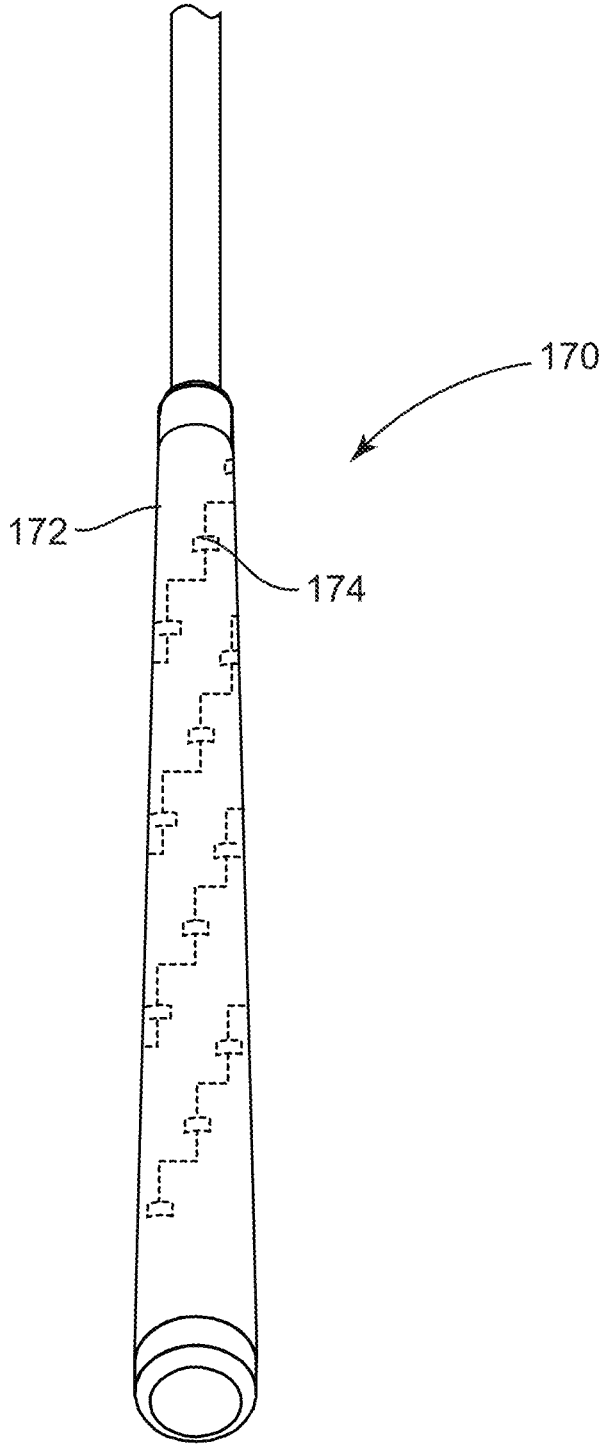
FIG. 21A is a perspective view of a golf grip with pressure sensors coupled to the grip or formed therein according to an embodiment.
Figure 21B:
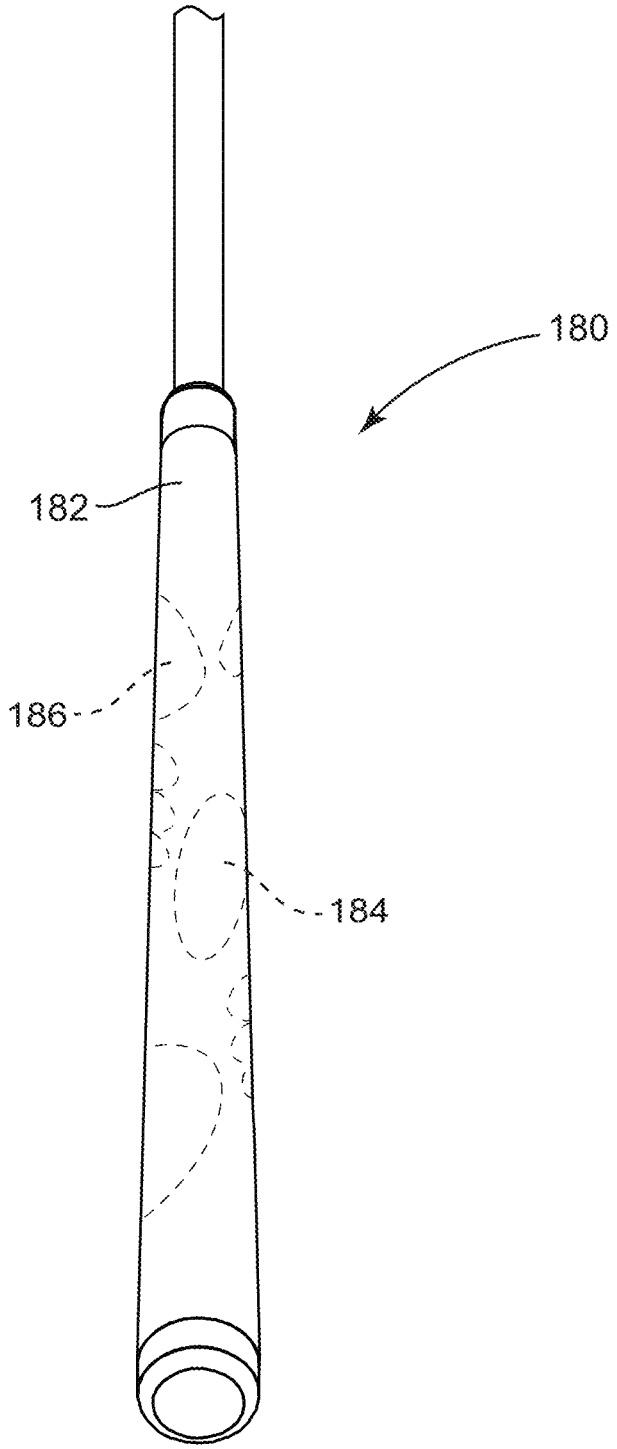
FIG. 21B is a perspective view of a golf grip with variable substrate golf grip according to an embodiment.

FIGS. 21A and 21B depict another embodiment of forming a customized golf club grip. FIG. 21A depicts a smart grip 170 that comprises sensors 174 embedded within the grip substrate 172 in order to obtain grip pressure data from multiple parts of the golfer's hands, including, without limitation, each finger, the palms, and other pressure points applied by the hands when gripping the smart grip, the magnitude of each pressure point, and the location of each pressure point on the smart grip. Collecting grip pressure data may include collecting grip pressure during an entire golf swing. This grip pressure data may then be stored in a server for later access and recall during manufacturing of the customized grip. The grip pressure data may then be utilized to manufacture a custom grip 180, utilizing two or more substrates 182, 184 and/or 186, forming the golf grip 180, as depicted in FIG. 21B. Manufacturing the custom grip 180 may include the use with at least a first substrate 184 and a second substrate 182, wherein the first substrate 184 is softer than the second substrate 182, wherein the customized grip 180 is formed with the first substrate 184 located in the location of pressure points that have the magnitude of pressure above a predetermined pressure magnitude and the second substrate 182 is located in the portion of the customized grip in locations where the magnitude of pressure is below the predetermined pressure magnitude.

Each location of greater pressure applied by the golfer's hands, and in the locations identified in the golf grip pressure data, may be formed of a different substrate. The type of substrate located in each defined area of the pressure points may be a uniform substrate different from the substrate forming the remainder of the golf grip. Further still, multiple substrates 182, 184 and 186 may be utilized, wherein some are softer than others in order to optimize the golf grip to account for pressure variations in the hands of the specific golfer. For example, the custom grip may be manufactured with more than two substrates, each substrate having a different level of firmness. Each range of pressure magnitude, of various predetermined ranges, corresponds to a substrate of a certain firmness. For example, the lower the range of pressure magnitude the greater the firmness of the corresponding substrate. Each substrate, of the more than two substrates, is located in a location associated with a pressure point within the range of pressure magnitude associated with that particular substrate firmness.

In at least these ways, a customized golf grip may be formed with variable substrates to account for pressure variations in the golfer's hands gripping a golf club, to thereby optimize the golf grip based on the pressure data recorded from the smart grip.

Additional embodiments are contemplated, to include, without limitation, a zipper within a grip that goes over an old grip, wherein the grip can be transferred from club to club; a mini grip that clamps over an old grip affecting just a few fingers; a glove that is padded to achieve the same results without altering grip; a sponge-like grip that lets you pronate and supinate each time you hold it, without a fixed custom or preferred hand placement; a hand/wrist analysis device/machine to be placed at golf stores sending data back for custom fitting; a smart glove that produces data for fitting or golfing; a grip that is custom for hands but also sends back swing path information for storage on a server for access later.

Applicant recognized the importance and necessity of the governing body rules of golf regarding conformity of clubs. A recent trend and change in golf equipment rules is the allowance of adjustable club heads to better accommodate the variable swings of the players. It is contemplated that future rule changes to allow adjustability in grips may be possible at the discretion of the governing body with proper research and application. Until such allowance, these grip inventions could provide useful training, feedback and data information for golfers.

Embodiments may be available on or through the internet, such as through domain names reserved and owned by Applicant that include smartgrip.golf, gripsmart.golf, gripsense.com, gripsense.golf, pressuregrip.com, golfgrip.app, ergonomic-grip.com, or the like.

Accordingly, the components defining any adjustable golf club grip may be formed of any of many different types of materials or combinations thereof that can readily be formed into shaped objects provided that the components selected are consistent with the intended operation of an adjustable golf club grip.

Furthermore, the components defining any adjustable golf club grip may be purchased pre-manufactured or manufactured separately and then assembled together. However, any or all of the components may be manufactured simultaneously and integrally joined with one another. If any of the components are manufactured separately, they may then be coupled with one another in any manner, depending on, among other considerations, the particular material forming the components.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description, as set forth, is not intended to be exhaustive or to limit the invention to the precise form disclosed. Many modifications and variations are possible, in light of the teachings above, without departing from the spirit and scope of the forthcoming claims.

The invention claimed is:

1. A method of creating a golf club with a customized grip, the method comprising:

receiving a grip mold squeezed by a golfer forming a unique anatomical mold of the golfer's hands;

forming the customized grip as a unitary body, wherein the customized grip is formed from the unique anatomical mold;

coupling the customized grip to a shaft of a golf club; and covering the customized grip with a uniform grip member, wherein forming the grip comprises forming a portion of the grip with a substrata member having a compressible material located in depressions of the customized grip formed from the unique anatomical mold.

2. The method of claim 1, further comprising providing a uniform visual grip with the grip formed from the unique anatomical mold and the substrata compressible material located under the uniform grip member.

3. The method of claim 1, wherein forming the customized grip further comprises 3D printing the customized grip.

4. A method of forming creating a golf club with a customized grip comprising:

collecting grip pressure data from a smart grip comprising imbedded pressure sensors, wherein the grip pressure data includes magnitudes and locations of pressure points of a golfer's hands gripping the smart grip;

manufacturing a custom grip with at least a first substrate and a second substrate wherein the first substrate is softer than the second substrate, wherein the customized grip is formed with the first substrate located in portions of the customized grip at locations where the magnitude of pressure is above a predetermined pressure magnitude and the second substrate is located in portions of the customized grip at locations where the magnitude of pressure is below the predetermined pressure magnitude; and coupling the customized grip to a shaft of a golf club.

5. The method of claim 4, wherein collecting grip pressure data includes swinging the golf club with the mart grip coupled thereto and collecting grip pressure data during an entire golf swing.

6. The method of claim 4, further comprising manufacturing the custom grip with more than two substrates, each substrate having a different level of firmness.

7. The method of claim 6, further comprising various predetermined ranges of pressure magnitude, wherein each range of pressure magnitude corresponds to a substrate of a certain firmness, the lower the range of pressure magnitude the greater the firmness of the corresponding substrate.

8. The method of claim 7, wherein each substrate of the more than two substrates is located in locations associated with pressure points within the range of pressure magnitude associated with that particular substrate firmness.

* * * * *